US005457293A

United States Patent [19]

Breed

[11] Patent Number: 5,457,293

[45] Date of Patent: Oct. 10, 1995

[54] INERTIA OR GRAVITY RESPONSIVE TILT SWITCH

[75] Inventor: David S. Breed, Boonton Township, N.J.

[73] Assignee: Automotive Technologies International, Inc., Boonton Township, N.J.

[21] Appl. No.: 247,759

[22] Filed: May 23, 1994

[51] Int. Cl.[6] ..... H01H 35/14; H01H 1/02

[52] U.S. Cl. ..... 200/61.52; 200/61.48; 200/61.49; 200/61.51; 200/61.83; 200/262; 200/DIG. 29; 335/151

[58] Field of Search ..... 200/61.45R–61.53, 200/61.45 M, 61.83, DIG. 29, 262; 335/151–154, 61.53, 61.45 M, 61.83, DIG.29; 218/91

[56] References Cited

U.S. PATENT DOCUMENTS

| | | | |
|---|---|---|---|
| 1,837,140 | 12/1931 | Thew | 200/61.49 |
| 2,487,433 | 11/1949 | Gardenhour | 200/DIG. 29 X |
| 3,567,881 | 3/1971 | Duimstra et al. | 200/61.53 |
| 3,673,362 | 6/1972 | Carlson et al. | 200/61.45 R |
| 3,674,950 | 7/1972 | Scoville | 200/61.48 |
| 3,715,535 | 2/1973 | Urenda | 200/61.53 |
| 3,911,666 | 10/1975 | Haber | 200/61.52 X |
| 4,013,526 | 3/1977 | Inoue | 204/129.46 |
| 4,016,752 | 4/1977 | Carey | 73/652 |
| 4,022,998 | 5/1977 | Fohl | 200/61.45 R |
| 4,948,927 | 8/1990 | Pajak | 200/33 R |
| 5,083,697 | 1/1992 | DiFrancesco | 228/116 |
| 5,155,308 | 10/1992 | Blair | 200/61.52 |
| 5,334,809 | 8/1994 | DiFrancesco | 200/262 |

*Primary Examiner*—J. R. Scott
*Attorney, Agent, or Firm*—Samuel Shipkovitz

[57] ABSTRACT

A unique geometry is used to amplify the force created by gravity on a tilting mass to substantially increase the resulting contact force in a mechanical tilt switch. In some cases a novel contact surface containing abrasive particles is also used to substantially reduce the contact force required to achieve a low contact resistance. The combination of these two features permits a substantial reduction in the size of the seismic mass needed for mechanical tilt switches and results in a switch which has a comparable size and comparable performance to mercury switches without the use of mercury. In some applications the effect of vibration is reduced by partially filling the switch housing with a damping fluid.

32 Claims, 22 Drawing Sheets

INERTIA OR GRAVITY RESPONSIVE TILT SWITCH

BACKGROUND OF THE INVENTION

Most tilt switches in use today use mercury. Mercury even in small amounts is toxic to the environment and particularly to human beings. It has been estimated that tens of millions of mercury switches are manufactured every year and thus, even though each switch contains only a small quantity of mercury, the total is significant. As a result, several states have considered banning the use of mercury switches.

In mercury tilt switches, the mercury is both the seismic mass and the electrical conductor which closes the electrical circuit. Impurities in the mercury tend to remain on the surface, thus clean liquid metal interacts with the solid metal electrical conductors to form a low-resistant conductive path from one conductor to the other.

To achieve a comparable low resistance using conventional switches, a substantial force is required between the switch contacts. This force is typically around 5 grams in order to produce contact resistances significantly below 0.1 ohms. Since tilt switches commonly operate when the tilt angle is less than 10 degrees, the mass of the seismic mass using a pivoting technology, for example, can become excessive. For example, in order to achieve a 5 gram contact force in such a system, the mass at an angle of 10 degrees would have to be approximately 30 grams. Such a switch would obviously be considerably larger than current mercury switches where the mass of the mercury is usually less than about 3 grams. Such switches, for example, could not be used interchangeably with current mercury switches. The substitution of mechanical switches in many cases would require significant design changes in devices which now use mercury tilt switches, such as emergency shutoff switches for irons, wall mounted silent switches and thermostats.

Mechanical tilt switches can also be sensitive to vibration which is less of a problem with mercury tilt switches. The presence of vibration can cause intermittent switch closures especially when the tilt switches are nearly at the marginal tilt angle.

These and other problems associated with prior art tilt switches are solved by the invention disclosed herein.

SUMMARY OF THE INVENTION

Preferred embodiments of the tilt switches of this invention utilize a unique geometry to amplify the force created by gravity on a tilting mass to substantially increase the resulting contact force. Sometimes a novel contact surface containing abrasive particles is also used to substantially reduce the contact force required to achieve a low contact resistance. The combination of these two features permits a substantial reduction in the size of the seismic mass needed for mechanical tilt switches and results in a switch which has a comparable size and comparable performance to mercury switches without the use of mercury.

In some applications the effect of vibration is reduced by partially filling the switch housing with a damping fluid. This fluid has a substantially higher breakdown voltage than gas and thus further serves to reduce arcing and therefore prolong the life of the contacts.

The principle objects of this invention are:

1. To provide a switch having a geometry which results in a mechanical advantage which amplifies the component of the force created by gravity on the seismic mass, in the direction of motion of the seismic mass, to increase the force between the contacts.
2. To provide a coating for the contact surfaces which contains abrasive particles and which results in a reduction in the contact resistance.
3. To provide a vibration damped mechanical tilt switch.
4. To provide a reed switch with lower contact resistance.
5. To provide a method of manufacturing a tilt switch where the contacts have a precise separation.
6. To provide a tilt switch where the body of the switch has a primarily vertical orientation.
7. To provide a mechanical tilt switch where the body has a primarily horizontal orientation.
8. To provide a mechanical tilt switch utilizing a rolling ball.
9. To provide a mechanical tilt switch having a snap through feature.
10. To provide a hermetically sealed tilt switch.

Other objects and advantages will become apparent from the discussion below.

DESCRIPTION OF THE PREFERRED EMBODIMENTS

Figure 1:
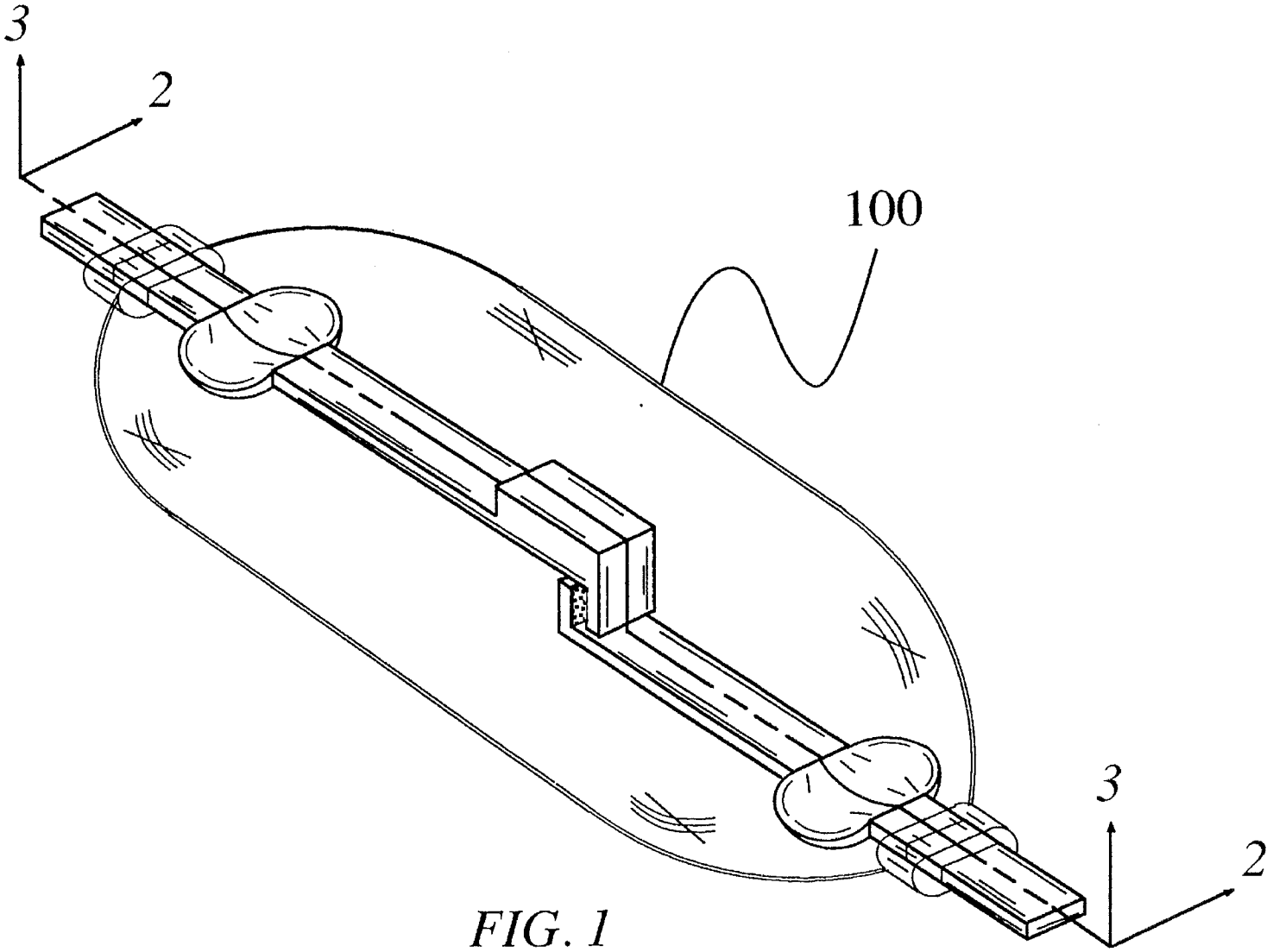
FIG. 1 is a perspective view of a preferred embodiment of the mechanical tilt switch of the present invention.
Figure 2A:
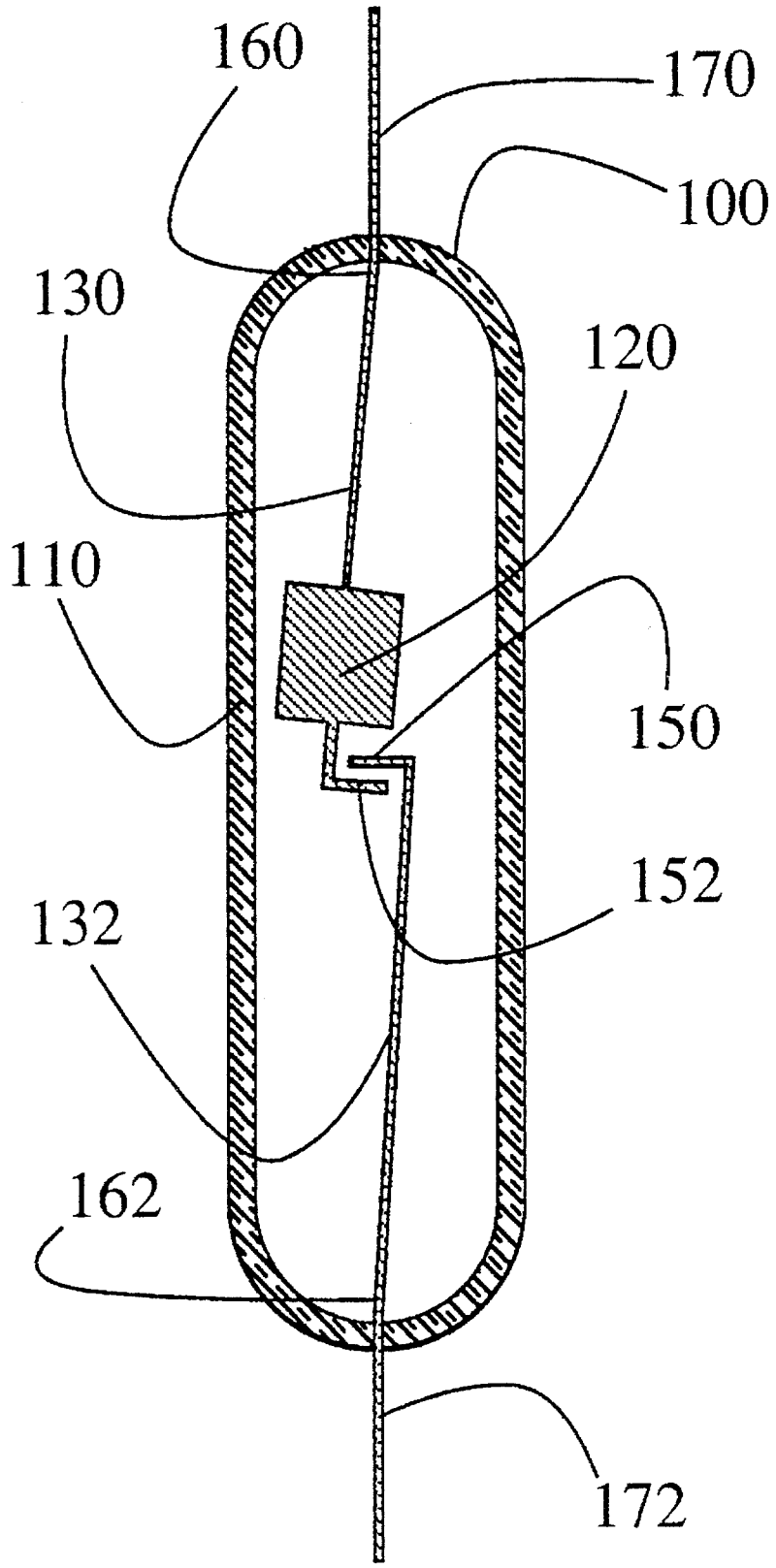
FIG. 2A is a cross sectional view of the apparatus of FIG. 1 taken along lines 2—2 shown in the non-actuation position.

The prospective view with certain parts removed of a preferred embodiment of a mechanical tilt switch of the present invention is shown at 100 in FIG. 1. A cross section view of the apparatus in FIG. 1, taken along lines 2—2 is shown in FIG. 2A. The same numbers are used to represent the same parts in FIGS. 1 through 6.

In FIG. 2A the switch is shown generally at 100. A glass housing 110 contains a beam 130 having a seismic mass 120 and a contact 152. A second beam 132 having a contact 150 is also enclosed in housing 110. Both beams 130 and 132 contain hinged portions 160 and 162 formed within the beam by a reduction in the arm thickness as described below. Beams 130 and 132 also contain lead sections 170 and 172 which are attached to the glass housing 110 and project through the housing for attachment to other apparatus not shown. In general, the contacts 152 and 150 may be attached to or a part of their respective beams 130 and 132. In both cases they will be considered as "integral with" their respective beams.

Figure 2B:
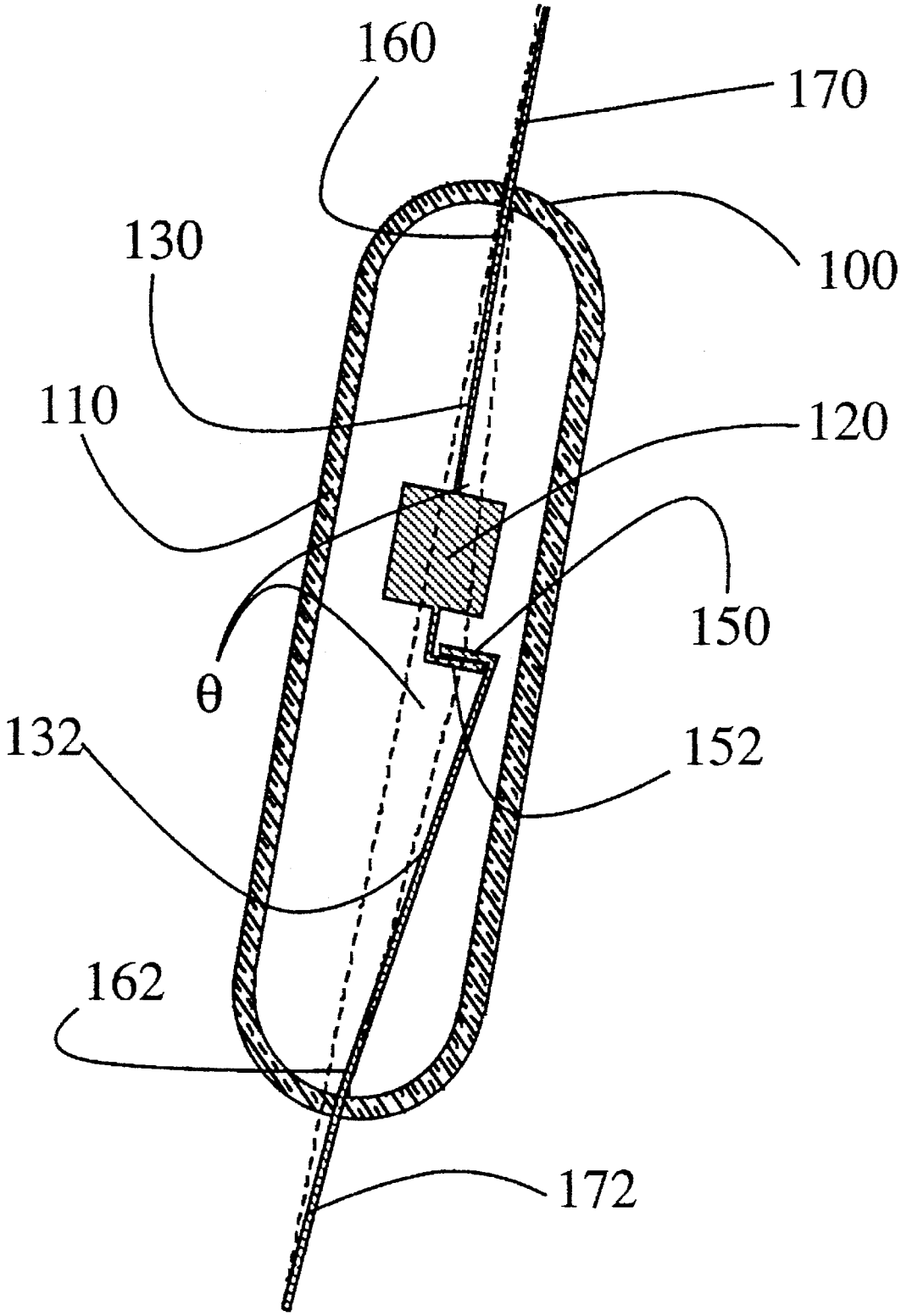
FIG. 2B is a cross sectional view of the apparatus of FIG. 1 taken along lines 2—2 shown in the actuation position.

If the tilt switch is tilted by an angle such as 10 degrees as shown in FIG. 2B the seismic mass 120 causes beam 130 to rotate about hinge 160. After a small motion such as 5 degrees, denoted by θ in FIG. 2B, contact 150 engages contact 152 and further motion of the seismic mass 120 is impeded. This creates a tension in beams 130 and 132 and a corresponding force between contacts 150 and 152 of the same magnitude. It will be shown below that through this geometry the force for the contacts created by the tilting of the tilt switch can be more than 10 times the force between the case of two parallel contacts. If the contacts were parallel, as shown in FIG. 4 for example, the force between the contacts would be approximately the same as the force on seismic mass 120 in the direction of its motion caused by the tilt of the switch. Thus through the geometry shown in FIGS. 2A and 2B, an amplification of the tilt force of a factor exceeding 10 is achieved. Alternately, to achieve the same contact force, the seismic mass 120 need be only one-tenth as great if the geometry of FIGS. 2A and 2B was used then if the geometry of FIG. 4 is used.

Figure 2C:
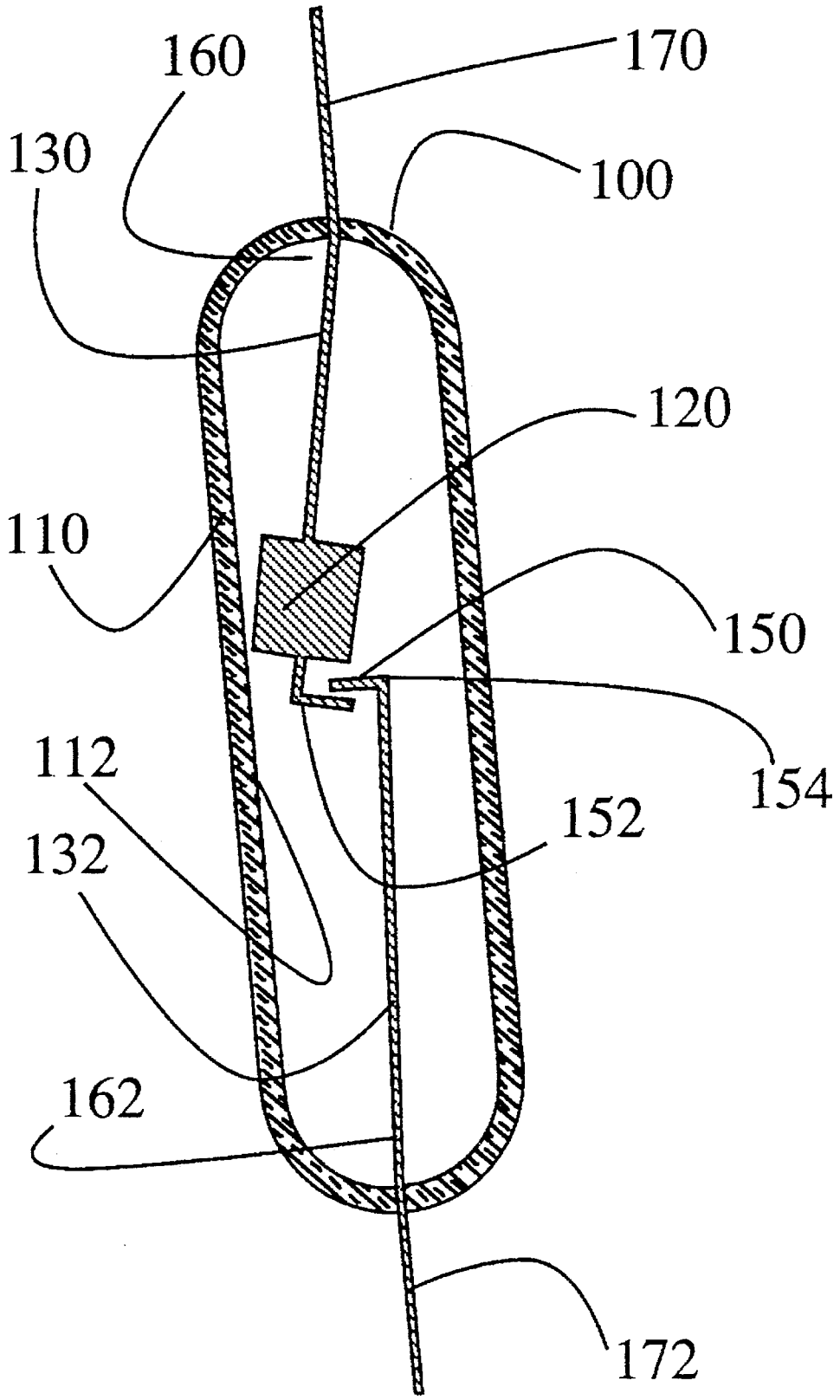
FIG. 2C is an enlarged cross sectional view of the apparatus of FIG. 1 taken along lines 2— 2 shown in the non-actuating position with the seismic mass resting against a wall of the switch housing.

FIG. 2C is a view similar to FIG. 2B with the tilt switch rotated in the opposite or non-actuation direction. In this case, wall 112, of housing 110 prevents seismic mass 120 from rotating more than a small angle.

Figure 2D:
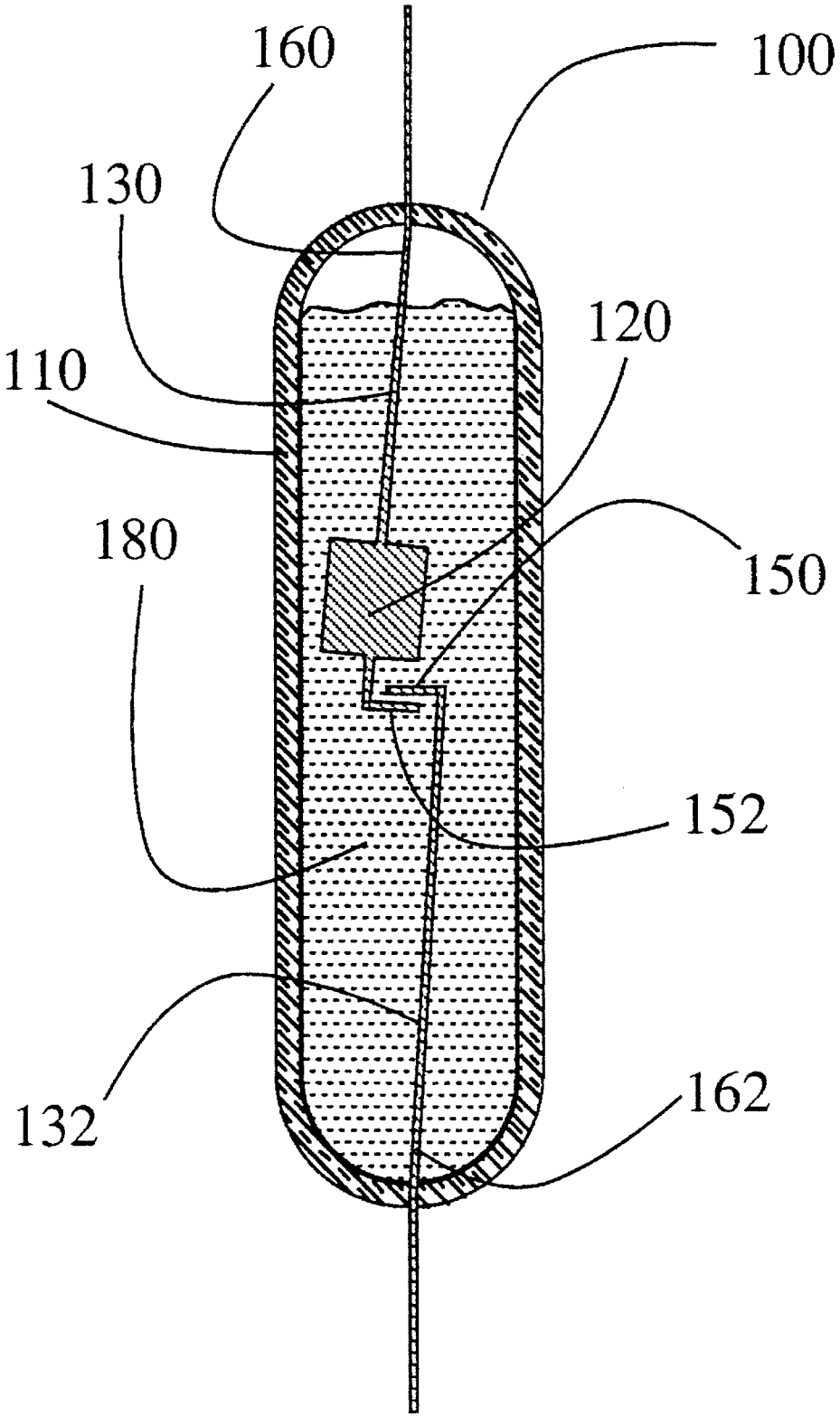
FIG. 2D is a cross sectional view of the apparatus of FIG. 1 taken along lines 2—2 shown in the non-actuating position with the switch partially filled with a damping liquid.

FIG. 2D illustrates the use of a fluid 180 to dampen the motion of seismic mass 120. If the tilt switch is in a position such as shown in FIG. 2A, slight vibrations could cause seismic mass 120 to cause beam 130 to rotate about hinge 160 and intermittently cause contacts 150 and 152 to engage. Such intermittent contact closures could have detrimental effects on equipment such as compressors. For this reason mercury tilt switches are normally provided with a mounting configuration which provides hysteresis such that once the contacts have closed, an adverse tilt of a minimum angle is required to open the switch. Naturally, a similar mounting system could be used with the mechanical tilt switch described herein. The effects of vibration, however, can also be mitigated through the use of fluid 180 which substantially fills housing 110 of the mechanical tilt switch of this invention. Fluid 180 reduces the effects of vibration significantly below that achieved with mercury switches by dampening the motion of seismic mass 120 and beams 130 and 132. The fluid 180, if properly chosen, has the added advantage of suppressing arcs between contacts 150 and 152 while the contacts are in the process of engaging or disengaging. Fluid 180 has a substantially higher breakdown voltage than gas, thus substantially reducing the separation distance required before sparking is eliminated.

Many different fluids would operate in the fashion described above, however, one preferred fluid is a silicone oil. Another preferred fluid is any fluid from the class of transformer fluids such as polychlorinated biphenyl (PCB), a common transformer fluid having good dielectric properties. Sometimes a small amount of a reducing agent can be added to the fluid to reduce the buildup of oxides or other undesirable films on the surfaces of contacts 150 and 152 further reducing their contact resistance.

Figure 3A:
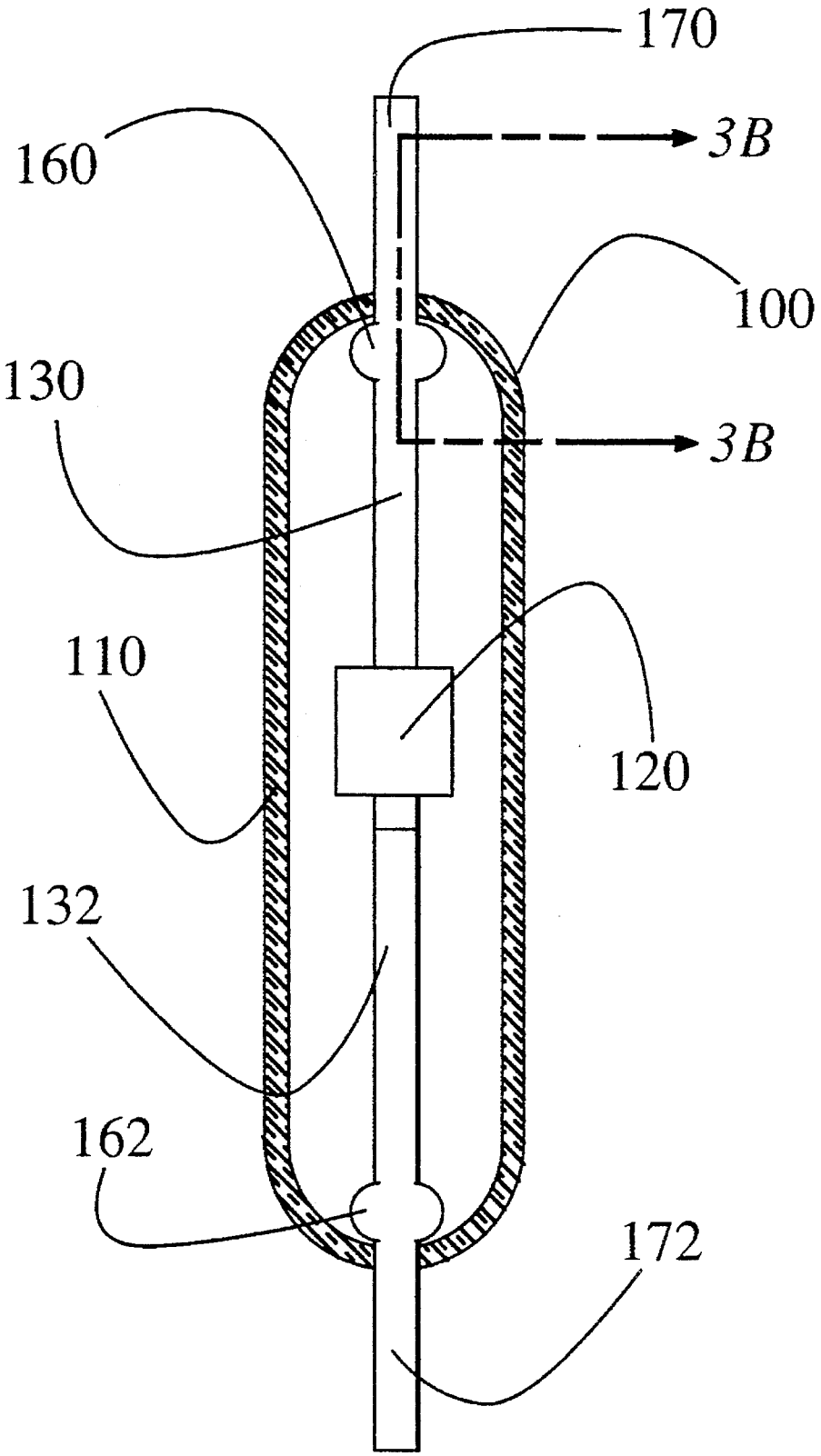
FIG. 3A is a cross sectional view of the apparatus of FIG. 1 taken along lines 3A—3A.

FIG. 3A is a view of the apparatus shown in FIG. 1 taken along the direction 3A—3A. Hinge portions 160 and 162 in beams 130 and 132 respectively are shown in this view and are created by a stamping or coining operation which reduces the thickness of the beams 130 and 132 forcing the excess material to be displaced laterally. Thus, the beam is substantially weakened for bending at the hinge locations without reducing the amount of material available for the conduction of the electricity. Naturally, in other applications, the excess material could be removed.

Figure 3B:
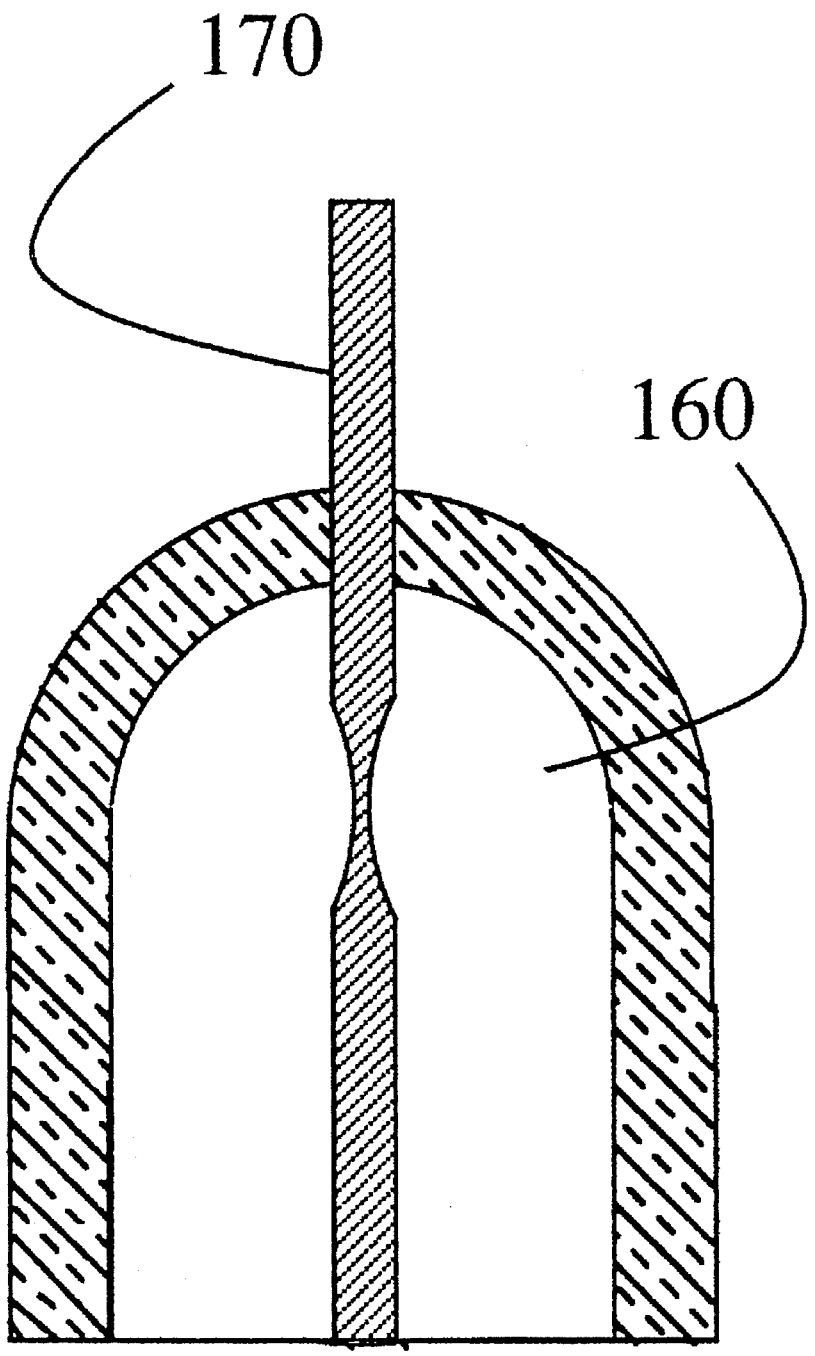
FIG. 3B is a cross sectional view of the hinge section of the apparatus of FIG. 3A taken along lines 3B—3B.

FIG. 3B shows an enlargement of the hinged area 160 shown in FIG. 3A taken along lines 3B—13B. In this view the thickness of the hinge 160 can be more easily seen.

Figure 4A:
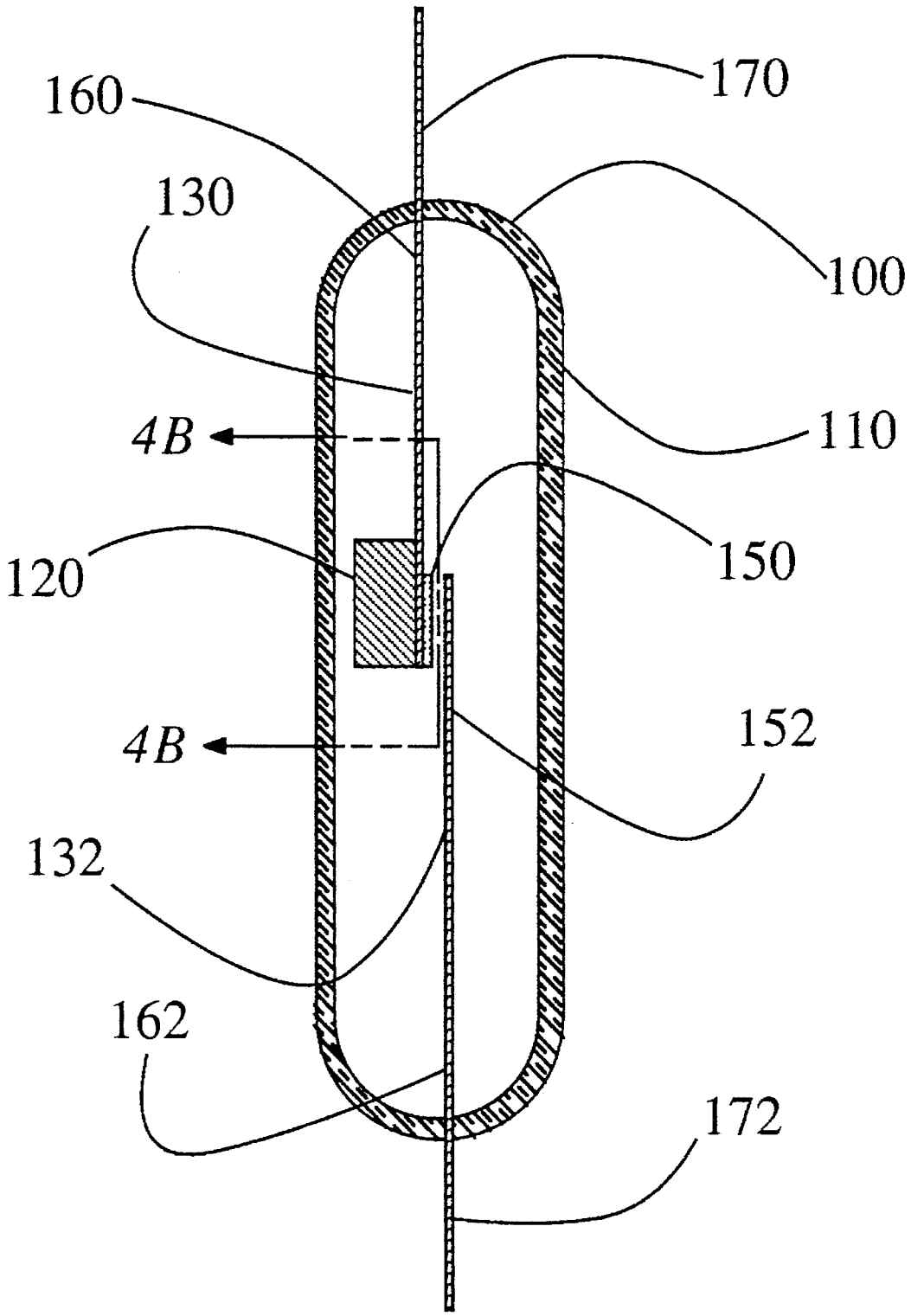
FIG. 4A is a cross sectional view of a modification of the apparatus of FIG. 1 taken along lines 2A—2A but with a different contact arrangement and where one of the contacts has a plating containing diamonds in a gold matrix.
Figure 4B:
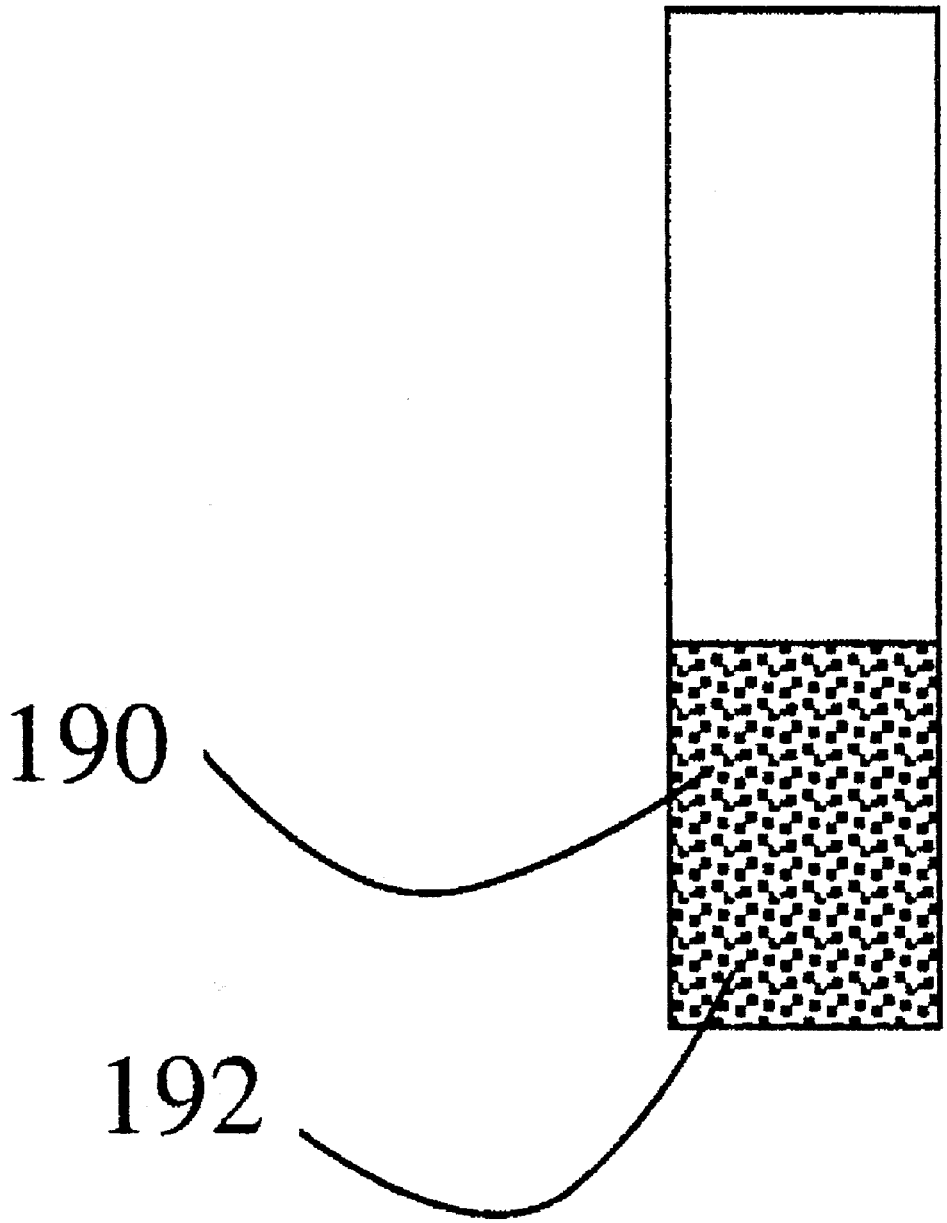
FIG. 4B is an enlarged view of the plating on one of the contacts taken along line 4B—4B of FIG. 4A.

FIG. 4A shows a tilt switch similar to that illustrated in FIGS. 1 through 3 without the mechanical advantage feature. In this case a contact surface 150 has been plated with abrasive particles put in a soft conductive matrix. Two patents have issued on the general process of using diamonds for coating conductors. They are U.S. Pat. Nos. 4,804,132 and 5,083,697, both to Louis DiFrancesco and both are hereby included herein by reference. According to the teachings of these patents, the abrasive particles 190 are held in a gold matrix 192 in the configuration of FIG. 4A and FIG. 4B which shows an enlarged view taken along lines 4B—4B of FIG. 4A. The abrasive particles are typically made from industrial diamond powder. The powder is first made conductive by a process such as sputtering and plated on surface 150 through a known plating process.

The preferred abrasive particles used in this invention are diamonds. However, other abrasive particles such as silicon carbide or aluminum oxide could also be used without deviating from this invention. It has been found that the combination of a soft plating material such as gold and the very hard abrasive particles such as diamonds results in a contact resistance approximately ⅛ that of the conventional gold plating. As a result, the size of the seismic mass required to achieve a particular contact resistance is also reduced by a factor of 8. This once again permits the construction of a mechanical tilt switch which is substantially smaller than would otherwise be possible. Also, the mass 120 in FIG. 4 can be made form tungsten, or other heavy material, which has a specific gravity of about 2.4 times that of steel, giving an added factor of 2.4 to reduce the size of the switch.

Naturally the combination of the plating system shown in FIG. 4 and the mechanical advantage shown in FIGS. 1 through 2 results in a mechanical tilt switch where the seismic mass is reduced by as much as a factor of 80, or almost 200 if tungsten is used, over that which would be required without these features. This combination permits the construction of miniature mechanical tilt switches which are comparable in size to currently produced mercury tilt switches without the use of mercury.

Figure 5:
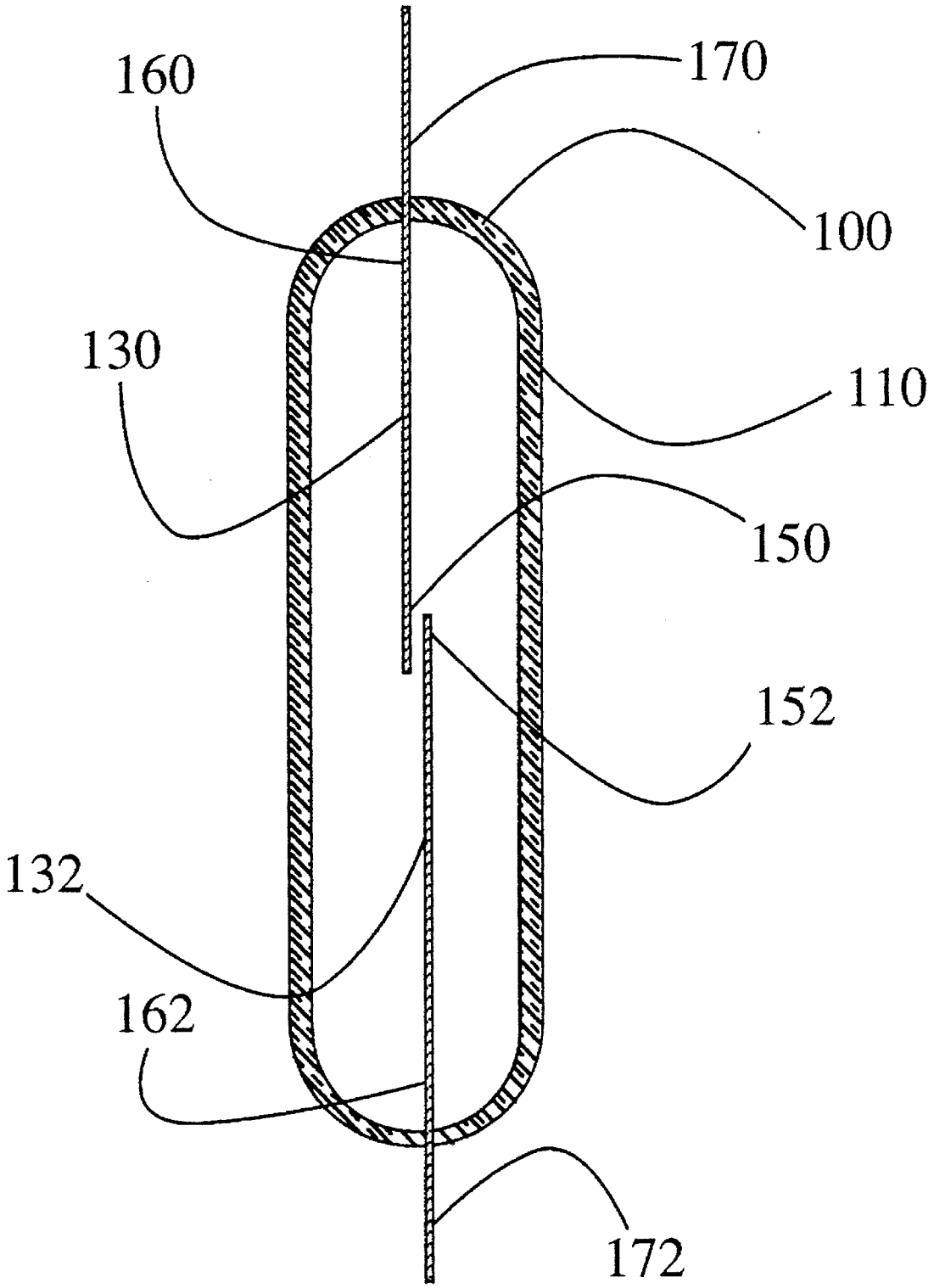
FIG. 5 illustrates the application of the teachings of this invention to a reed switch.

The teachings of this invention can also be applied to conventional reed switches as shown in FIG. 5. Due to the very small contact force present in conventional reed switch designs, the contact resistance is substantially higher than mechanical switches. In one application, for example, where a reed switch is used as part of an automobile crash sensor for use with airbags, this high contact resistance causes the reeds to weld together when the current which is required to fire an airbag is passed through the switch. Through the implementation of the teachings of this invention, this contact resistance could be substantially reduced either through the use of the mechanical advantage technique shown in FIGS. 1 through 3 or the gold and abrasive particle configuration shown in FIG. 4. This is shown in FIG. 5 where one or both of the contacts 150 and 152 are plated with abrasive particles in a soft conductive matrix.

Figure 6A:
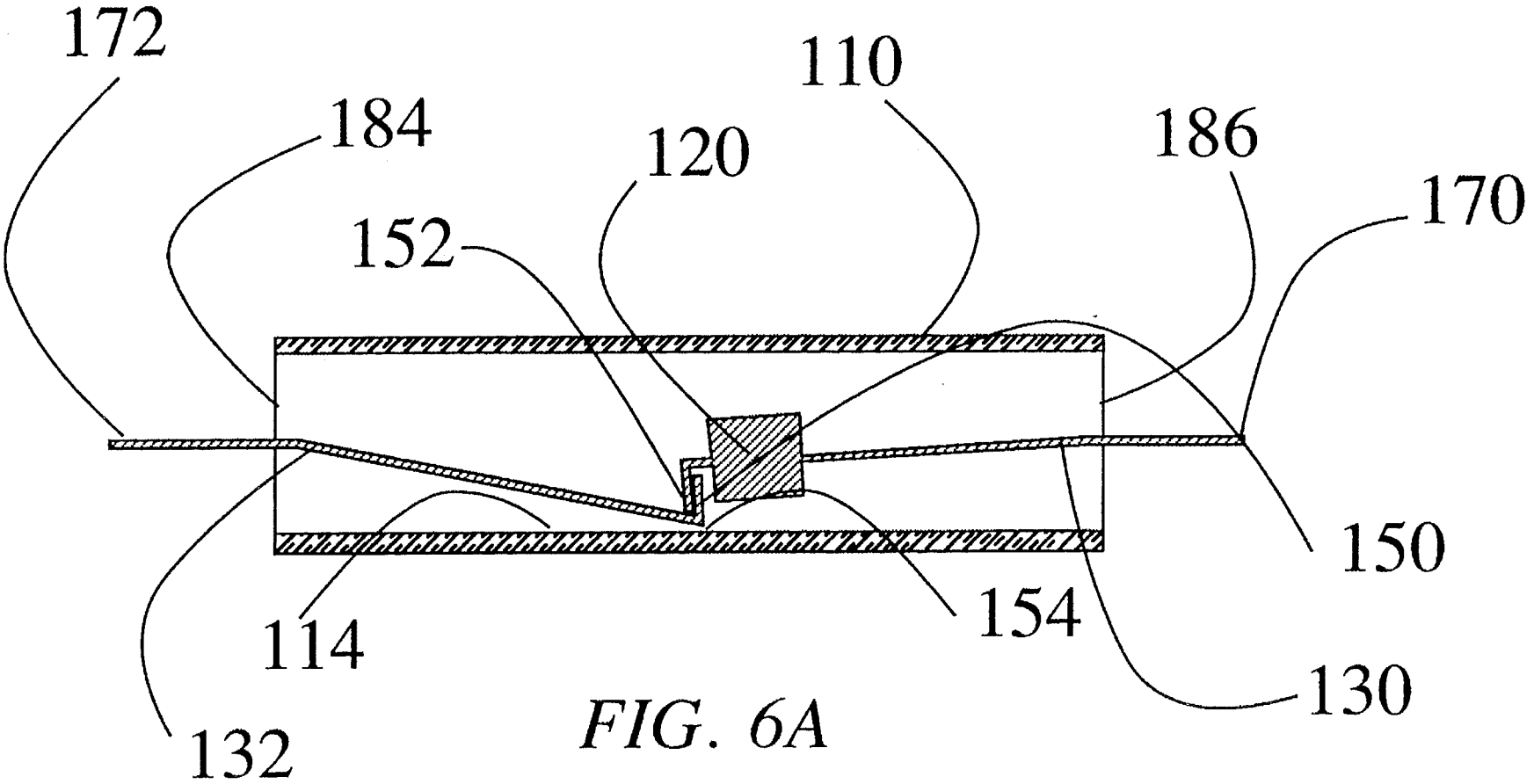
FIG. 6A illustrates the first step of one possible manufacturing sequence for making a preferred embodiment of the tilt switch of this invention where the contacts have been inserted into a section of glass tubing.
Figure 6B:
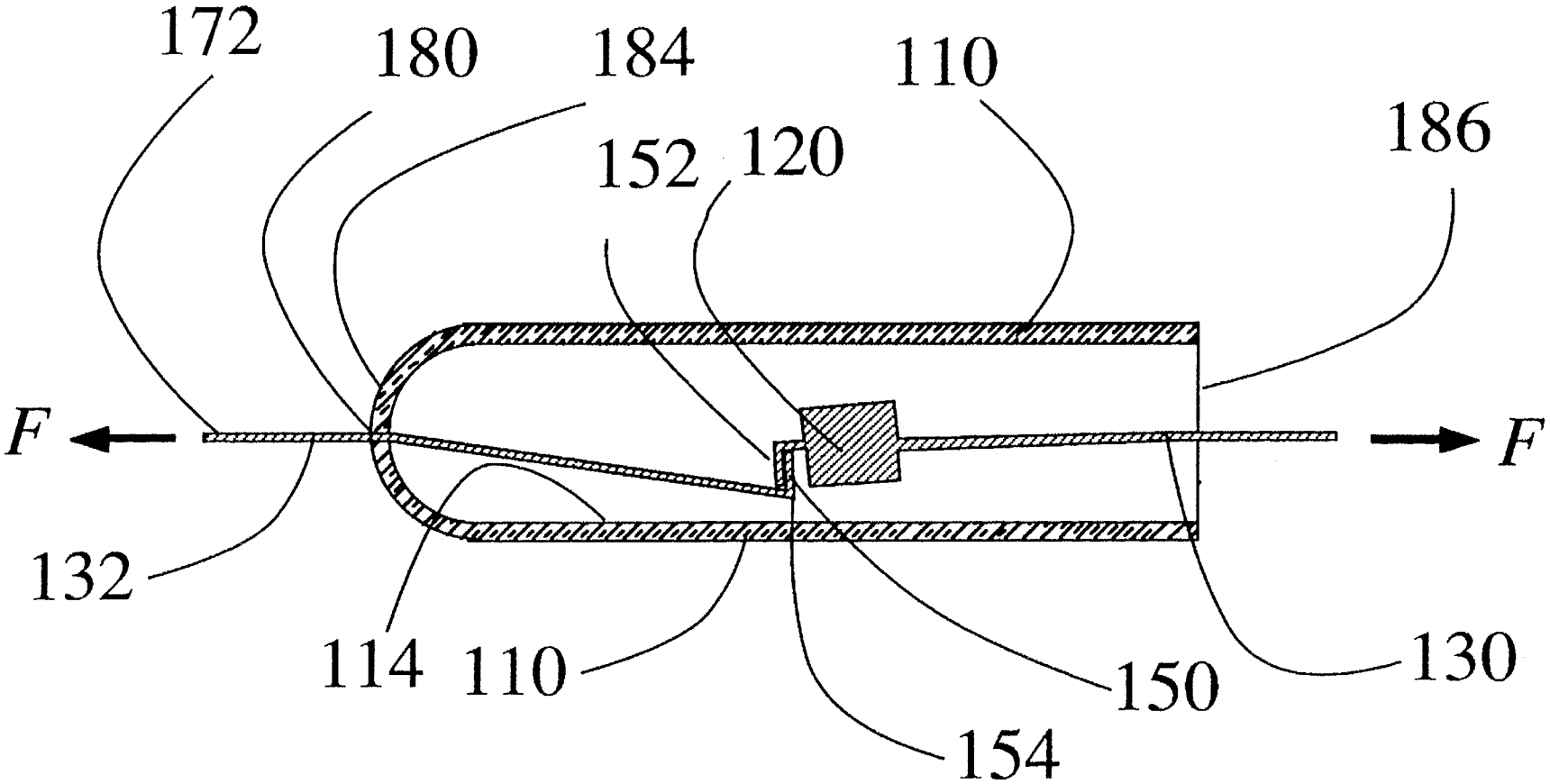
FIG. 6B illustrates the second step of one possible manufacturing sequence for making a preferred embodiment of the tilt switch of this invention where the contacts have been inserted into a section of glass tubing and one end of the tubing has been sealed and tension has been applied to the ends of the contact leads.
Figure 6C:
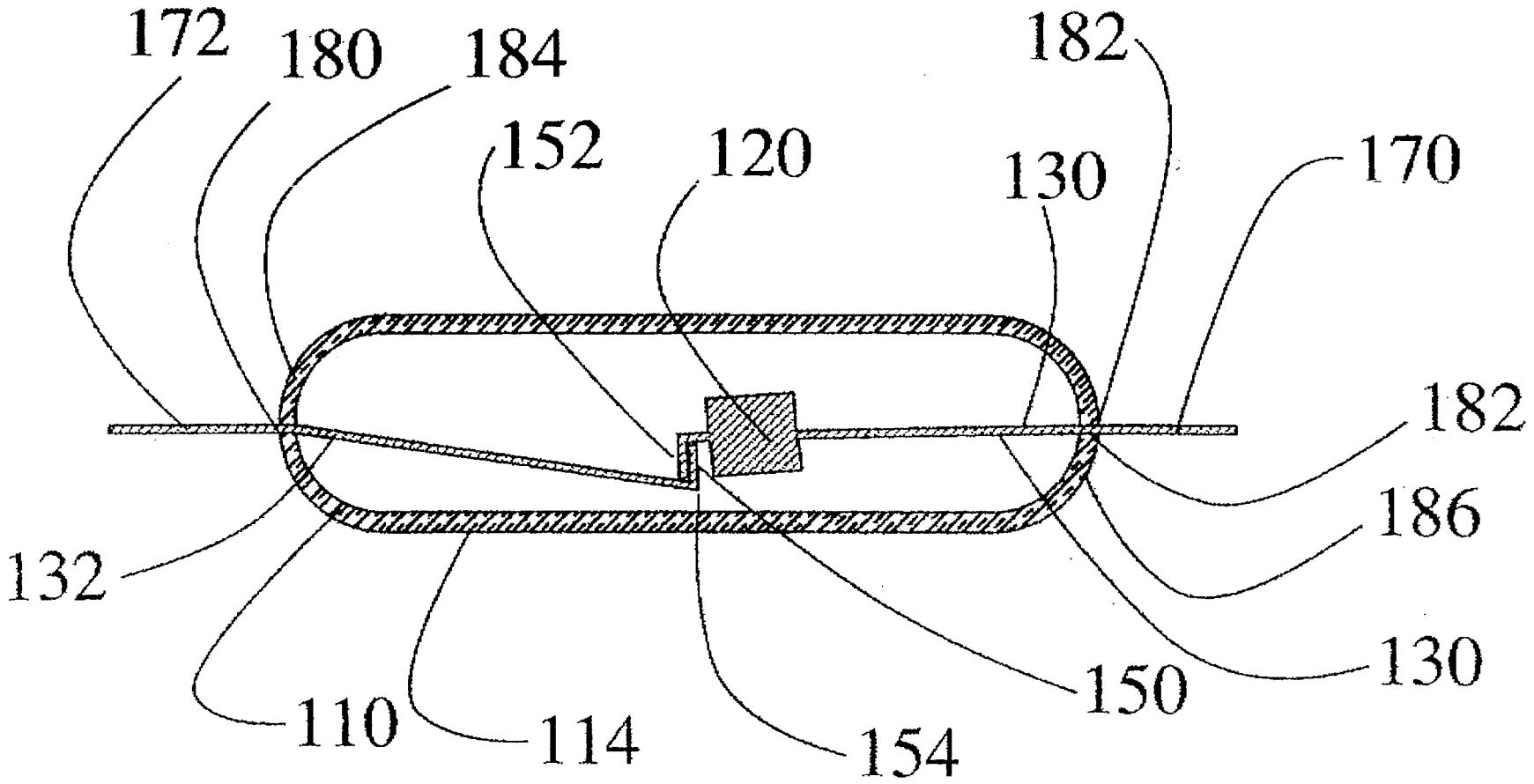
FIG. 6C illustrates the third step of one possible manufacturing sequence for making a preferred embodiment of the tilt switch of this invention where the contacts have been inserted into a section of glass tubing and both ends of the tubing has been sealed and the tension has been released.

FIGS. 6A through 6C illustrate the steps of a preferred manufacturing sequence used to create a preferred embodiment of the tilt switch of this invention. The beams 130 and 132 are formed using conventional stamping and metal forming equipment. Mass 120 has been attached by means of staking, gluing, soldering or other convenient joining process. Contacts 150 and 152 are then engaged and the beam mass and contact assembly is placed inside of a glass tube 110 as shown in FIG. 6A. End 184 of housing 110 is then formed by heating the glass causing it to seal around lead 172 of beam 132. In this manner, a seal 180 is formed between the glass housing 110 and the beam 132 as shown in FIG. 6B. In FIG. 6A, edge 154 of contact 150 is resting against wall 114 of housing 110 and is lifted off wall 114 when sufficient force is applied to leads 170 and 172.

The force F on leads 170 and 172 is now increased until edge 154 is lifted off of wall 114 as shown in FIG. 6B. At this point the glass at end 186 of tube 110 is heated and formed and in a similar manner, the seal 182 is formed between housing 110 and lead 170 as shown in FIG. 6C.

This entire manufacturing process is done with the tilt switch in the horizontal position as shown in FIGS. 6A through 6C. In this manner, when the switch is in use, the edge 154 will never touch the housing and the entire force created by tilting the switch is available to be amplified and translated into a contact force between contacts 150 and 152. Also, by this process a precise gap is assured between contacts 150 and 152 when the switch is vertical and in the open state.

Naturally the same manufacturing processes could take place with the device at some other tilt angle between the actuation desired tilt angle and the horizontal with similar benefits. Also, although the process was described using glass for the housing, a similar process exists for the case where the housing is made from plastic.

In the manufacturing process illustrated in FIGS. 6A through 6C, tension was maintained on leads 170 and 172 in order to ensure that contacts 150 and 152 remain engaged. An alternate process would be to put a minute amount of adhesive between the contacts which could later be evaporated or otherwise removed when the initial current is passed through the switch.

Naturally other manufacturing steps or variations of the above sequence are possible.

In the tilt switches illustrated thus far only a component of the force of gravity acting on the seismic mass is available to create a contact force. Also, in the tilt switches illustrated thus far, the switch requires mounting with its housing primarily in the vertical direction. Most mercury switches operate with the housing primarily in the horizontal direction. Both of these features can be accomplished using a rolling mass in place of the pivoted mass illustrated thus far. One example of such an embodiment is shown generally at 200 in FIG. 7. In this case a spherical mass 220 is utilized which rolls in housing 210. For non-actuation angles, mass 220 rests on surface 213 of insulator 212. Insulator 212 can be part of housing 210 or a separate part. Beam contact 230 is also attached to insulator 212 in such a manner that it can rotate about the attachment 242. Contact beam 232 is similarly attached to the housing by means of attachment 241.

Figure 7:
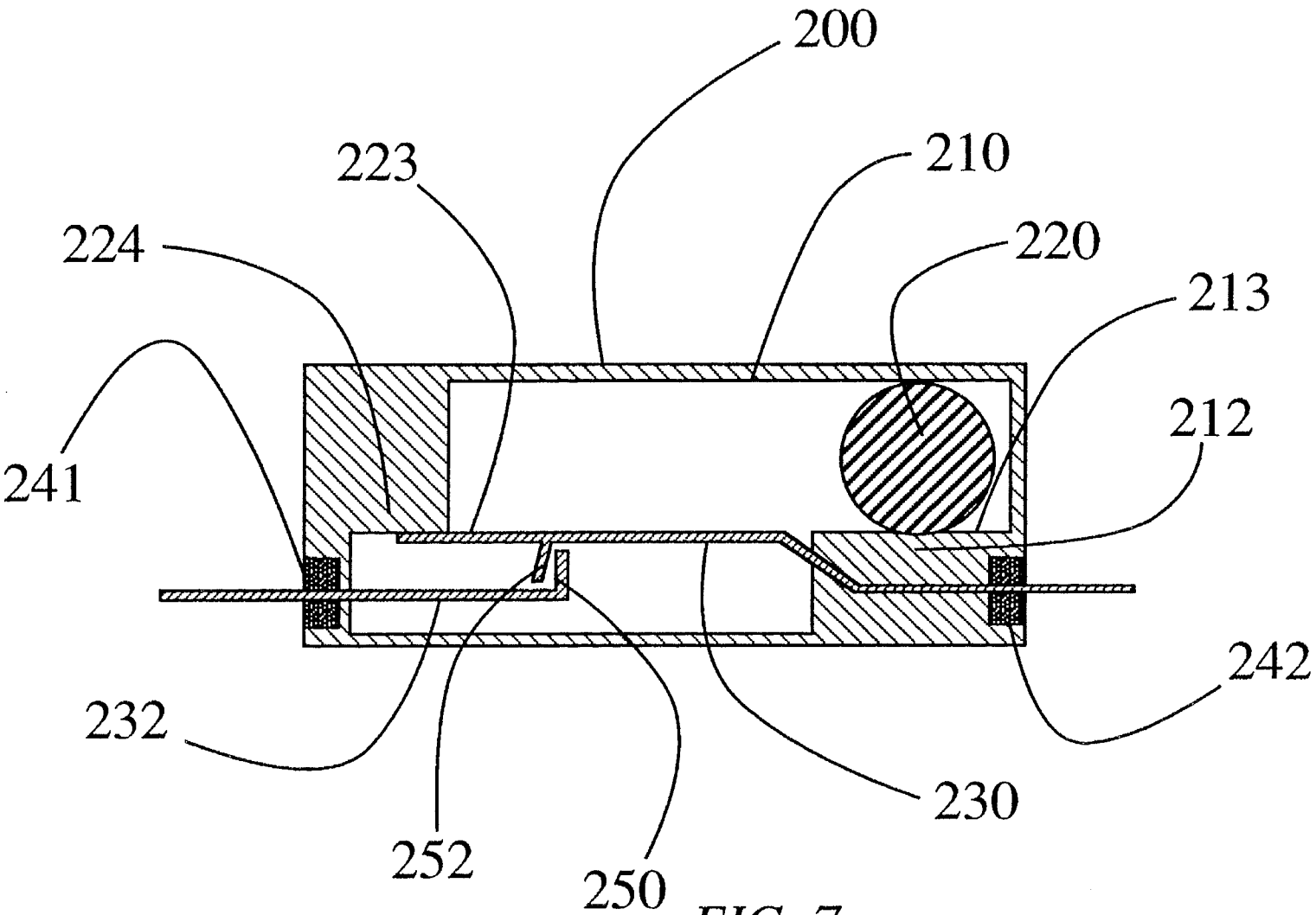
FIG. 7 is a cross section view of a horizontal implementation of the teachings of this invention where the seismic mass is a rolling ball.

When the tilt switch rotates counter-clockwise in FIG. 7, mass 220 rolls toward end 223 of contact beam 230 at which point its entire mass is acting on contact beam 230 causing it to tilt downward and similarly causing contacts 250 and 252 to engage. This engagement creates the same mechanical amplification as illustrated in the examples of FIGS. 1 through 3. The mass 220 in this case, however, can be substantially smaller than the mass 120 in the previous examples since the entire force of gravity acting on this mass 220 creates a contact engagement force. The mass 220 can also be manufactured from a heavy material such as tungsten or uranium.

In this implementation, contact 230 is slightly biased upward so that in the non-activated position it rests against insulator 224 which can be a separate part of housing 210.

Naturally, abrasive particles could also be placed on one or both of the contact surfaces 250 and 252, as described above, further reducing the contact resistance and therefore permitting even a smaller mass 220 to be utilized. In this manner a miniature mechanical tilt switch can be effectively created. Such a switch would be comparable in size to currently used mercury switches and since the housing is primarily mounted horizontally, it can be used as a direct replacement for current mercury switches.

In all of the examples illustrated so far, the leads have protruded from opposite ends of the sensor housing. Many mercury switches have both leads coming out of the same end which can be easily accomplished in the design of FIG. 7, for example by reversing the direction of beam 232 to cause it to protrude from the right end portion of the housing.

Figure 8:
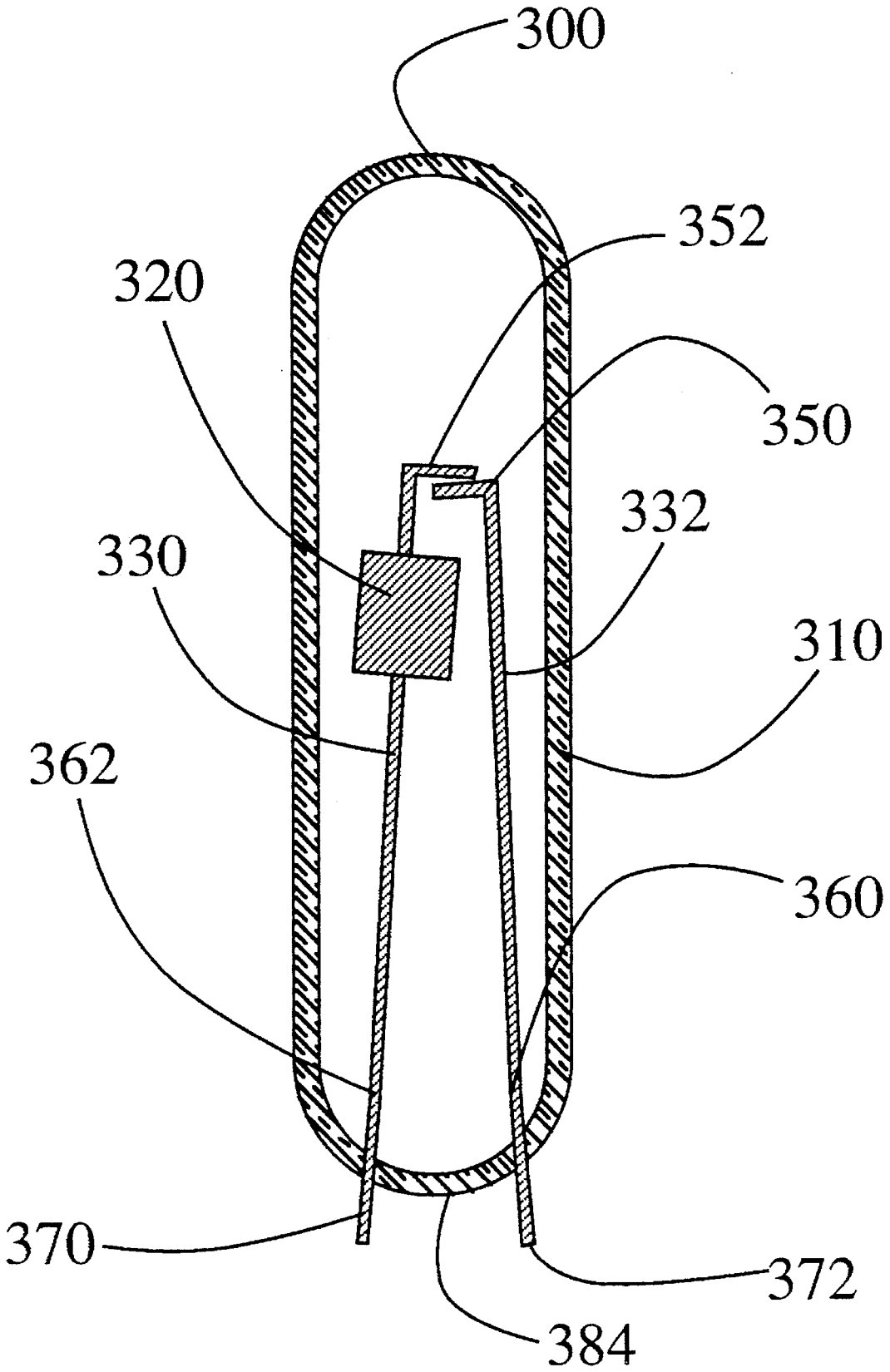
FIG. 8 is a cross section view of another implementation of the tilt switch built according to the teachings of this invention where both contact leads emerge from the same end of the switch housing.

Another example of a tilt switch where both leads emanate from the same end of the housing is illustrated in FIG. 8. In this illustration beam 332 is now in compression whereas beam 330 remains in tension when contacts 350 and 352 engage in a similar manner as described above. In other aspects the switch illustrated in FIG. 8 performs in the same manner as that illustrated in FIGS. 1 through 3. The switch is shown generally at 300 and comprises switch housing 310 and beams 330 and 332. These beams have hinges 360 and 362 respectively and leads 370 and 372. Seismic mass 320 is acted upon by gravity when the switch is turned clockwise by a sufficient amount.

Figure 9:
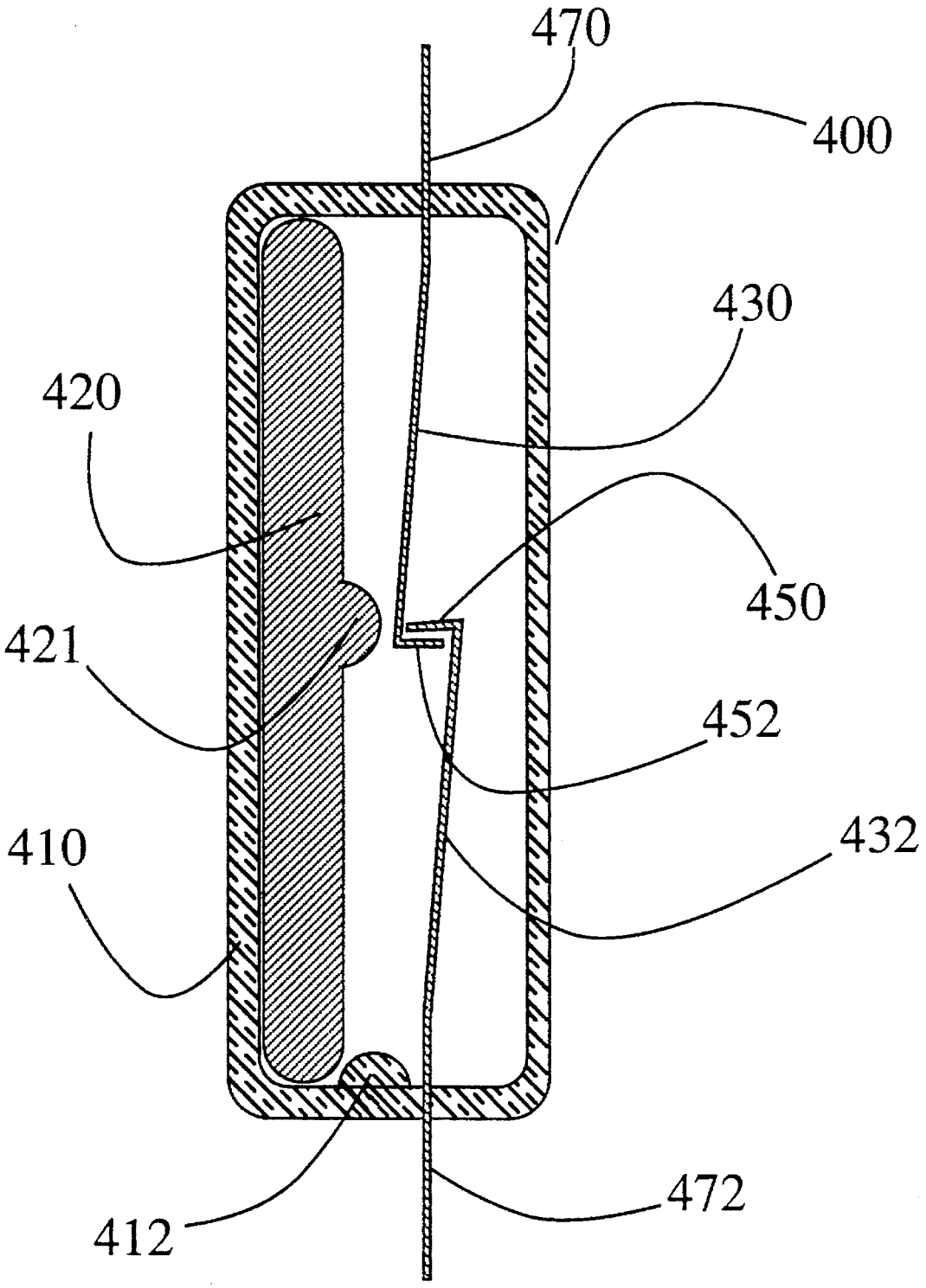
FIG. 9 is a cross section view of an alternate preferred embodiment where the seismic mass is separate from the contacts and is constrained to rotate in the switch housing.

FIG. 9 illustrates one of many possible examples where the seismic mass is not attached to the switch beams. In this case the switch is shown generally at 400 and seismic mass 420 is held in housing 410 and constrained to rotate due to protrusion of 412. A projection 421 from mass 420 is aligned to interact with contact 452 forcing it to engage contact 450 when the switch is rotated clockwise in FIG. 9. In this case beams 430 and 432 do not contain weakened or hinged sections and the flexure of the beams themselves act as hinges. Since the beams do not have to support the weight of the seismic mass, they can be substantially weaker. The configuration shown in FIG. 9 has the advantage that substantially more mass 420 is available since it does not need to be supported by one of the contact beams. This also substantially reduces the effect of vibrations on the beam 430. For these reasons, the design shown in FIG. 9 results in the smallest design of the vertically mounted switch examples shown here.

Figure 10:
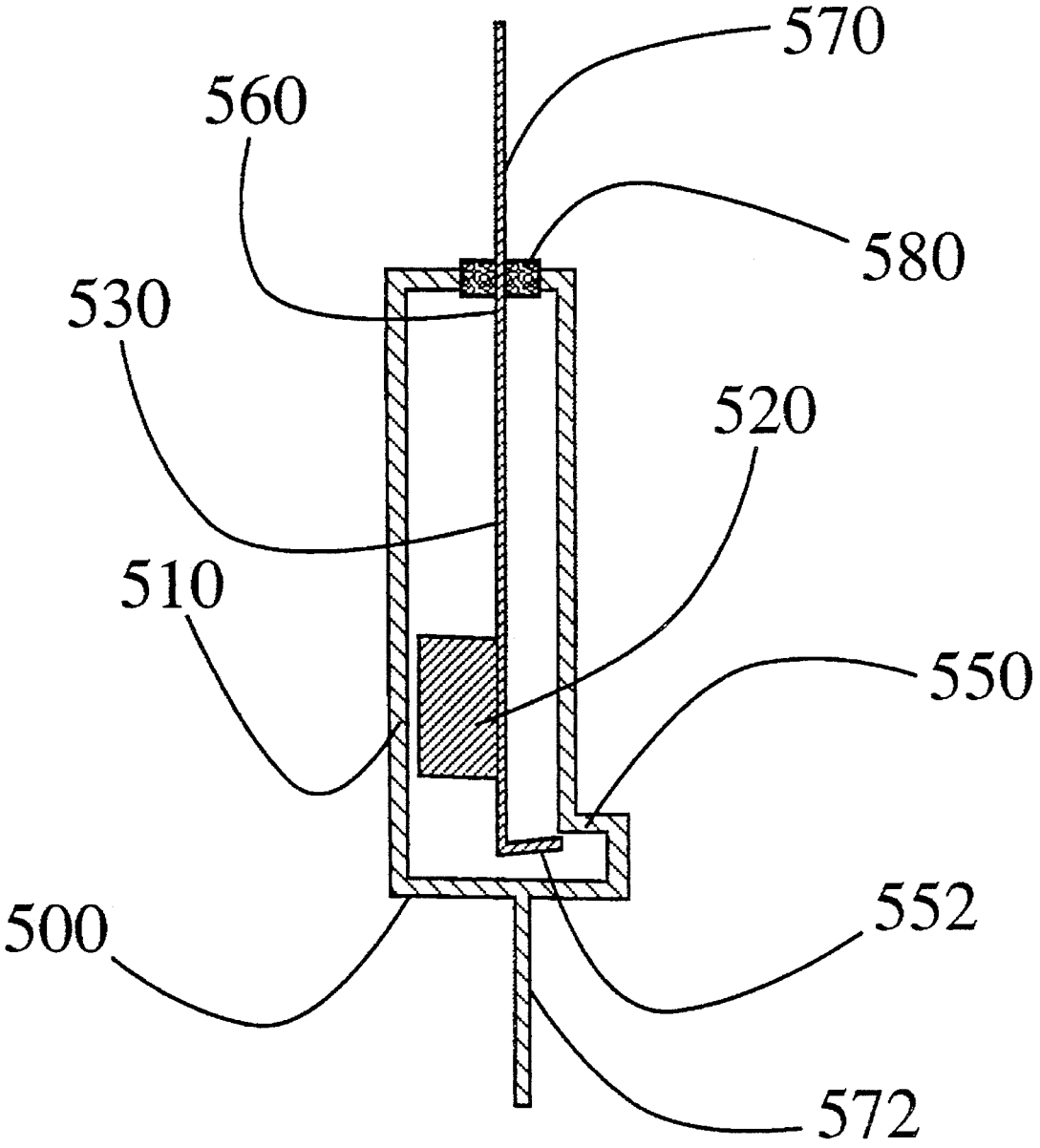
FIG. 10 is a cross section view of yet another preferred embodiment where the housing is used as one of the electrical contacts.

In some cases it is desirable to use the housing itself as one of the conductors. An example is illustrated in FIG. 10 where housing 510 is now constructed of metal instead of plastic or glass as in the previous examples. Contact beam 530 however now must be insulated from housing 510 which is accomplished by means of an insulating sealing member such as 580. Such a sealing member can be obtained as a standard glass to metal header seal. In this case, the sensor which is shown generally at 500 contains a housing 510 which is formed partially into a contact at 550. Contact 550 is engaged by contact 552 when the switch is rotated clockwise in FIG. 10.

Figure 11:
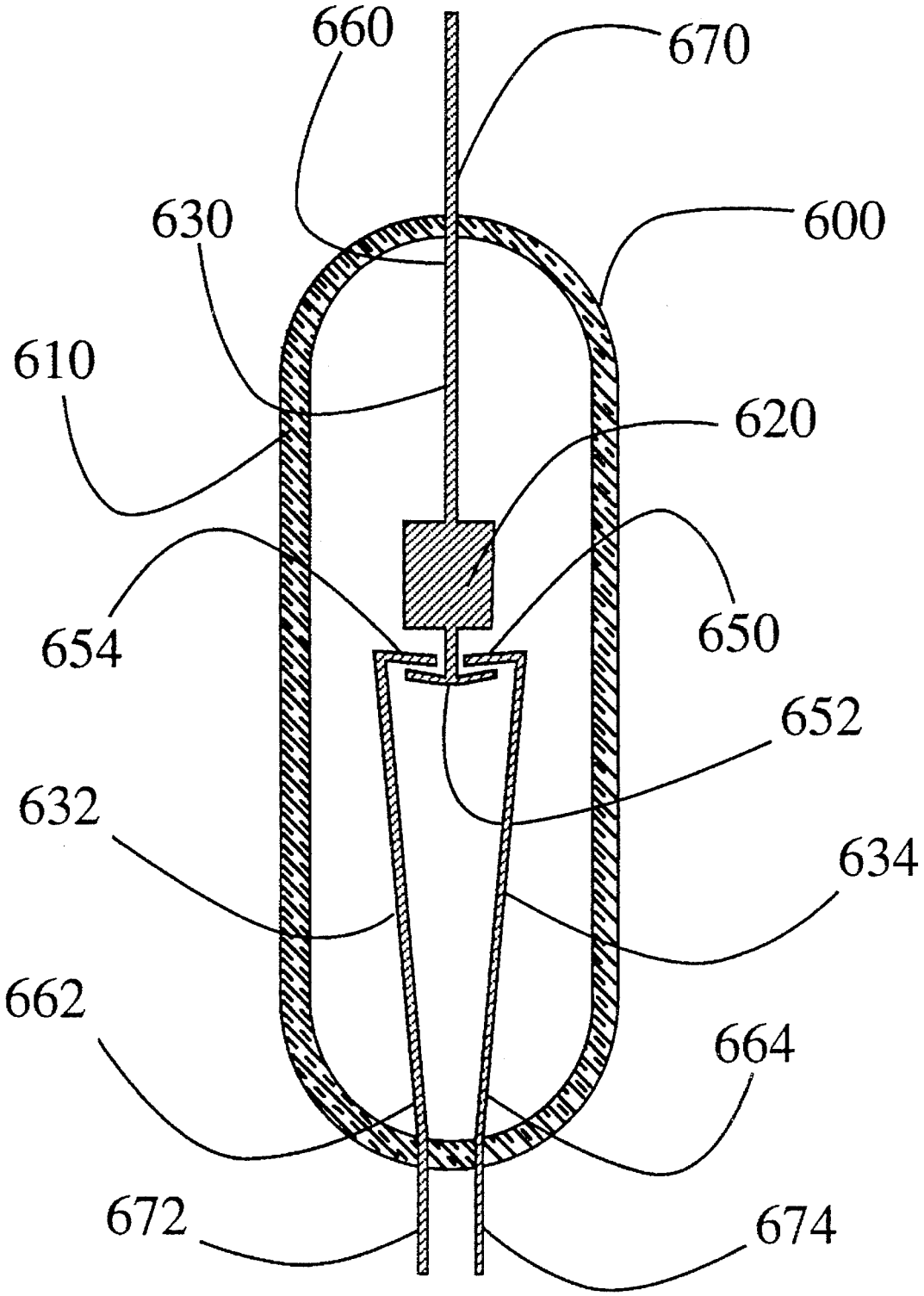
FIG. 11 is a cross section view of a preferred embodiment where the switch activates one circuit for a clockwise tilt and a second circuit for a counterclockwise tilt.

In the illustrations of FIGS. 1 through 10 a single pole switch has been illustrated. In FIG. 11, a dual pole switch is shown wherein one circuit is closed for a counter-clockwise rotation and a different circuit for a clockwise rotation. This device shown at 600 contains a housing 610 which can be made of an insulating material such as plastic or glass. Attached to the housing are beams 630, 632 and 634. Each of these beams contains a hinged section 660, 662 and 664 respectively and a lead 670, 672 and 674 respectively. This switch is designed such that a clockwise motion of the tilt switch as shown in FIG. 11 causes contact 652 to engage contact 650 and a counter-clockwise rotation would cause contact 652 to engage contact 654.

Figure 12:
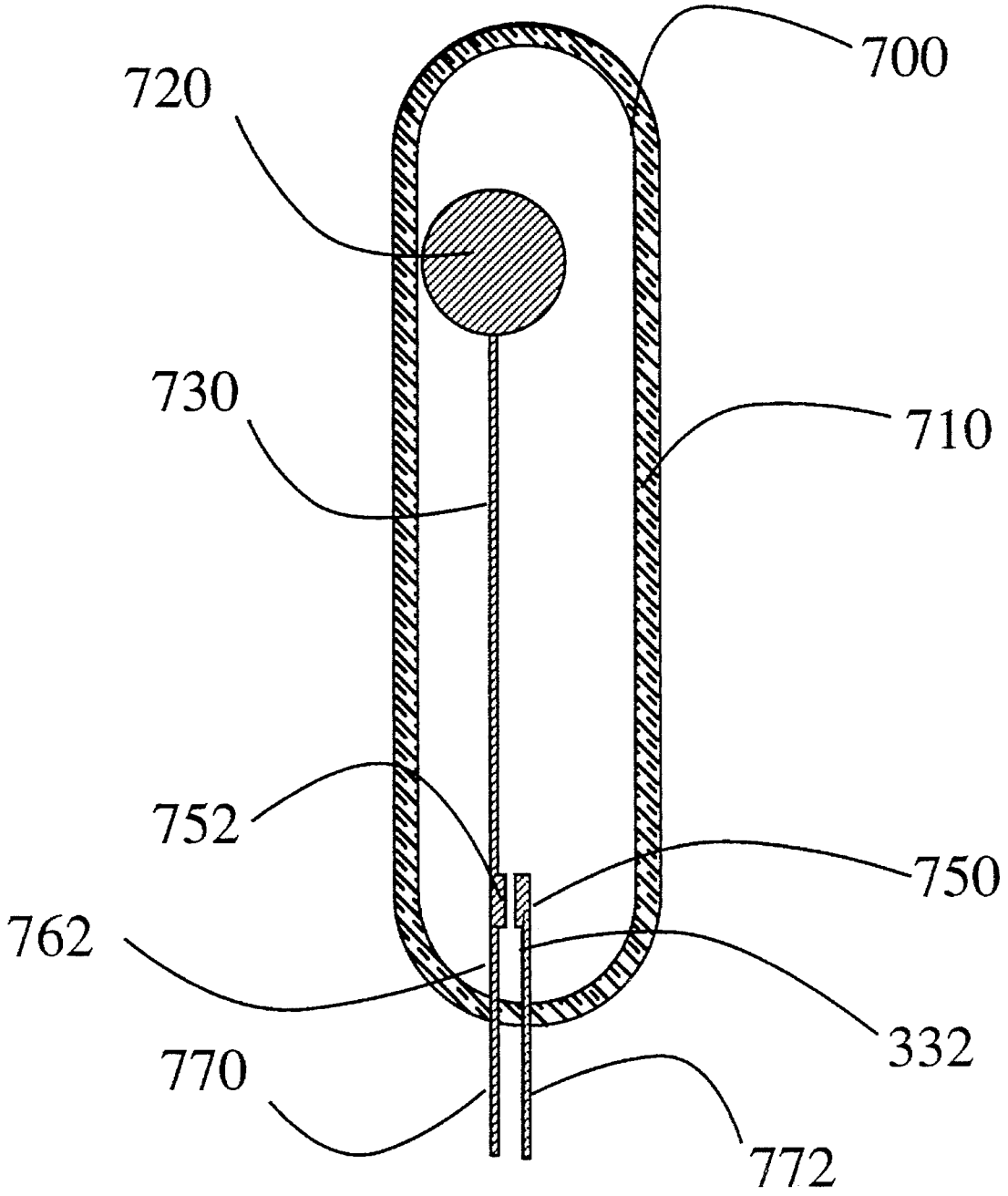
FIG. 12 is a cross section view of another preferred embodiment where the mechanical advantage is obtained through a difference in the lengths of the switch lever arms.

The force amplification methods illustrated so far have utilized the large tension created in the beams by a mass coupled with a small angular deflection of the beams to create the mechanical advantage. An alternative design is shown generally as 700 in FIG. 12 where the seismic mass 720, which is mounted on beam 730, is located at a substantial distance from the pivot 762. The contact 750 and 752 now are in a parallel configuration and at a much smaller radius than the seismic mass at 720. When the switch of FIG. 12 is rotated in the clockwise direction, the torque exerted by seismic mass 720 about hinge 762 is equal to $M\ G\ L \sin\theta$ where M is the mass of 720, G is the acceleration of gravity, L is the length of beam 730 from hinge 762 to the center of mass 720, and $\theta$ is the angle of rotation. To oppose this torque, a force is created between contact 750 and 752 which is equal to $(L/X)(M\ G \sin\theta)$, where X is the distance from the point of engagement between the contacts 750 and 752 to hinge 762. If L is large compared to X, a significant magnification of the force results permitting a reduction in the required mass 720.

In order to provide a minimum contact force and to prevent intermittent contact closures at the marginal tilt angle, mercury switches are frequently mounted flexibly such that when the mercury flows from one side of the switch to the other, the added mass of the mercury increases the tilt angle of the switch. This provides a hysteresis effect to the switch. In the case of a thermostat for example, the angle required to turn on a furnace or air conditioner would be slightly different from the angle required to turn off the device. This would translate into the case of a furnace, for example, where if a thermostat was set at 70 degrees, the furnace would go on when the temperature dropped below 69 degrees and turn off when the temperature reached 72 degrees. The width of this hysteresis zone in this case is 3 degrees. That of course could be varied for different applications.

Figure 13A:
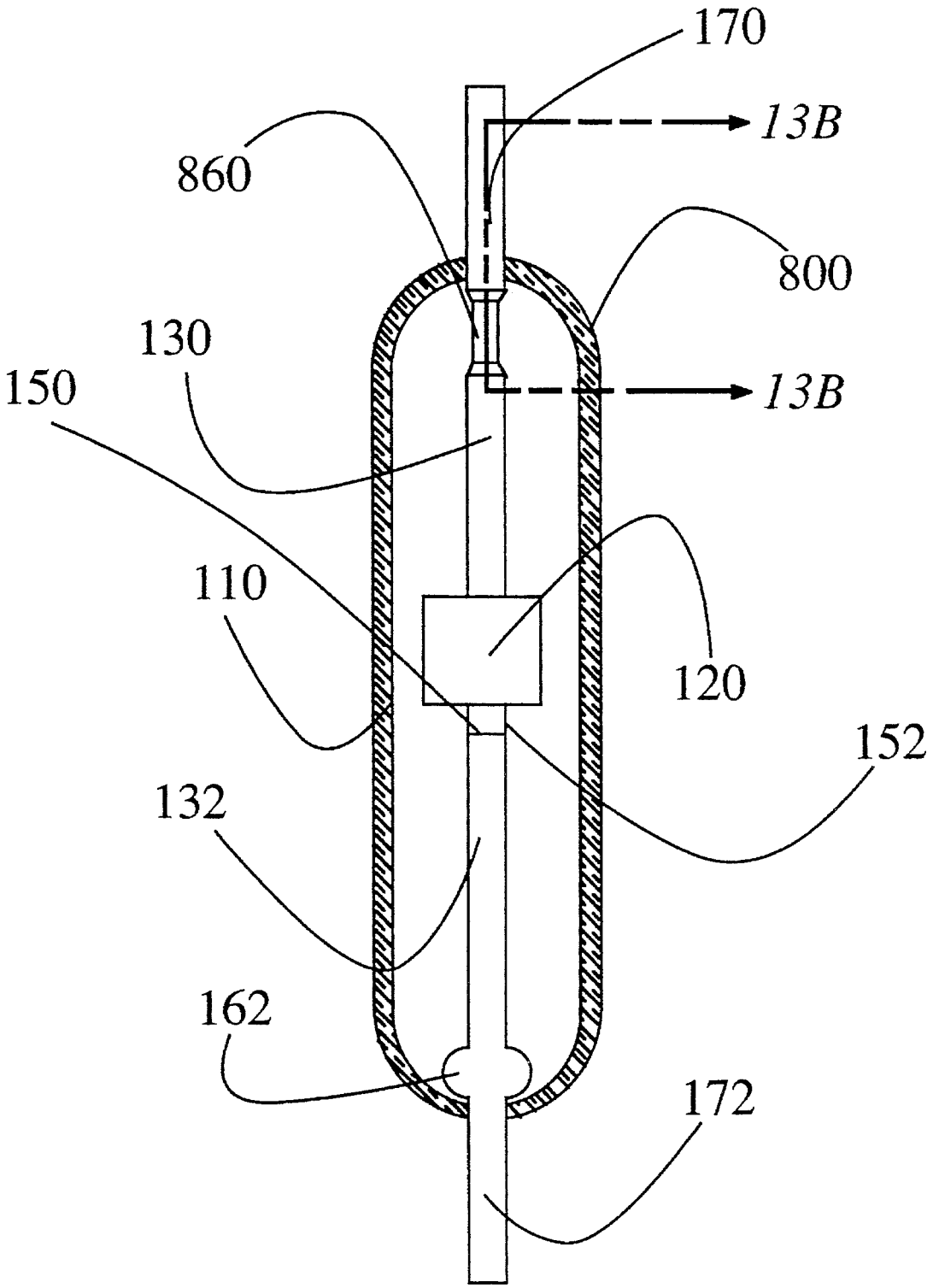
FIG. 13A is a cross section view of one of many possible snap through mechanisms which can be incorporated into the switch.
Figure 13B:
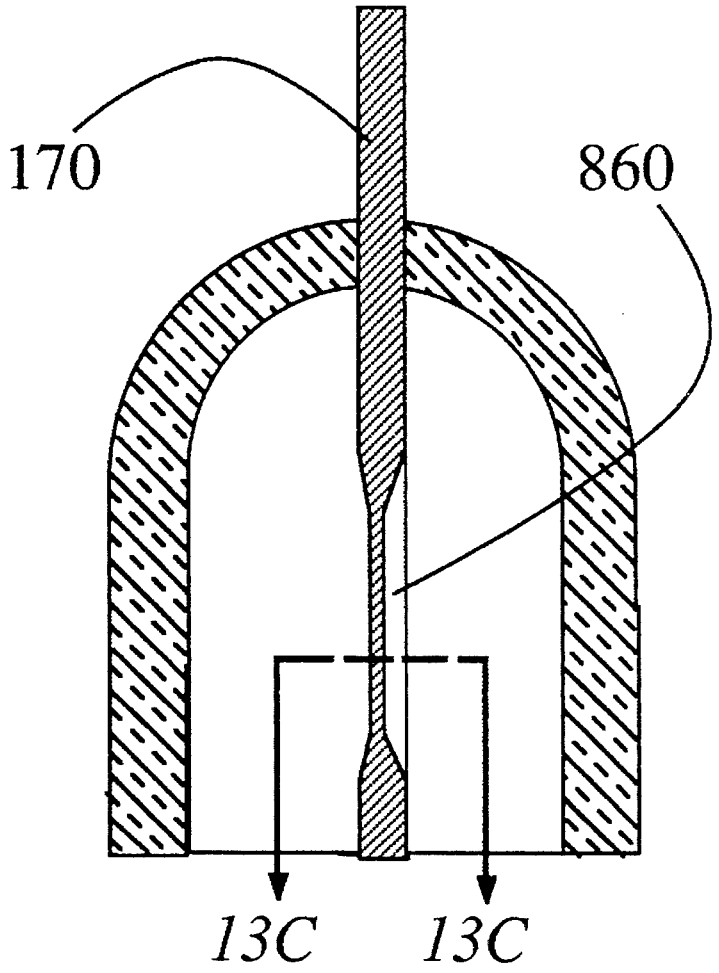
FIG. 13B is an enlarged view of the snap through hinge mechanism of the tilt switch of FIG. 13 taken along line 13B—13B.
Figure 13C:
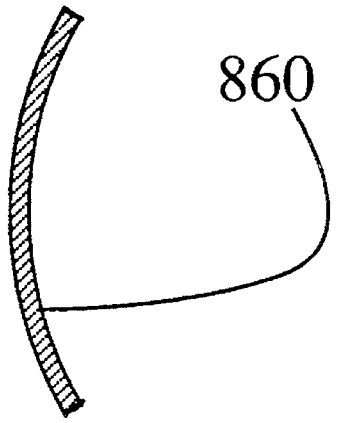
FIG. 13C is another further enlarged view of the snap through hinge mechanism of the tilt switch of FIG. 13A taken along line 13C—13C.

A similar hysteresis effect will take place in the tilt switches disclosed herein if they are similarly mounted on flexible structures. Alternately, a snap action effect can be designed into the switch itself as illustrated in one example which is shown generally at 800 in FIGS. 13A through 13B. In this case the hinge 860 of beam 130 would be slightly longer and have a curved cross-section. An enlargement is shown in FIG. 13B which is a view of the switch taken along lines 13B—13B of FIG. 13A and in FIG. 13C a view of the cross-section of the hinge 860 taken along the lines 13C—13C of FIG. 13B. In this configuration, when the seismic mass 120 rotates causing contacts 150 and 152 to engage as described above, the rotation will be opposed by the requirement that hinge 860 buckle in a manner similar to that which occurs when a metal tape measure is bent. This creates a snap through feature which requires a significantly larger force to initiate bending of beam 130 until a threshold has been exceeded at which point the force opposing the bending caused by the hinged 860 suddenly drops. In this manner the contacts are maintained at a minimum separation distance until the actuation tilt angle is exceeded at which point the contacts rapidly engage thus minimizing arcing effects.

Naturally many other snap action designs could be incorporated into the switch designs described above. A particular design illustrated in FIG. 13A is meant merely to be illustrative. A whole variety of such snap mechanisms are commonly used in micro-switches as well as other switch designs.

Hysteresis can also be designed into the other implementations illustrated above. The amount of hysteresis which occurs in the design of FIG. 8, for example, can be controlled by the angular distance which beam 330 is permitted to rotate counter-clockwise before mass 320 interacts with housing 310. If the torque produced by hinge 362 is small, mass 320 will rest against housing 310 until the gravitational force vector passes through the pivot 362. Shortly thereafter mass 320 will leave contact with housing 310 and rapidly move into a position where contact 352 engages 350. It will remain in this position until once again the gravitational force vector passes through pivot 362 when the switch is rotated in the counter-clockwise direction of FIG. 8.

For mechanical contact arrangements for most switches, it is desirable that the contacts wipe, that is, that the surface of one contact scrape across the surface of the other. In this manner oxide films or other contaminants are penetrated. When the abrasive system illustrated in this invention is used, wiping is not necessary or even desirable. The minute microscopic abrasive particles which are incorporated in the contact surface successfully penetrate surface contamination to immediately achieve high quality contact.

Seismic masses having a cylindrical or rectangular cross-section and spherical rolling ball seismic masses have been illustrated here. Naturally other shapes could be used including rolling cylinders or portions of a spherical mass. A particular choice of mass shape would depend on the desires of the switch designer and on the particular application.

In the rolling ball device illustrated in FIG. 7 the housing was designed so that the ball would travel in a substantially straight line. If additional hysteresis is desired in the switch, a provision can be made to require the ball to roll over a bump, for example, prior to touching beam 230 and causing contacts 250 and 252 to engage. In this manner the amount of hysteresis in the rolling ball system can be controlled.

In the device illustrated in FIG. 8 the beams are shown pointed upward. Naturally this switch could be inverted so that beams 370 and 372 emerge from the top of housing 310 instead of the bottom as shown in FIG. 8.

In the preferred implementation of the present invention, the seismic mass and contact beams are hermetically sealed in glass. In other applications plastic may be utilized instead of glass and the sealing may be truly hermetic or in some cases the sensor may not be sealed at all.

In the examples illustrated herein, a hinge was formed in the contact beam by a stamping or metal forming operation. Naturally other techniques exist for creating pivots or hinges which would give the same or similar end result. Thus, although one particular type of hinge has been illustrated, the invention disclosed herein is not limited to this particular hinge design.

When the tilt switch of the present invention is tilted, an actuation force is created which is equal to the component of the total gravitational force on the seismic mass which is available to be used to create a contact engagement force. In the case of the rolling ball design of FIG. 7, the actuation force is equal to the mass of mass 220 times the acceleration of gravity times the cosine of the tilt angle. For a small tilt angle, the actuation force is nearly equal to the weight of the ball 220. In the case of the hinged system shown in FIGS. 1 through 2 the actuation force is equal to the mass of the seismic mass 110 times gravity times the sine of the tilt angle.

The engagement force, as used herein, means the actual force between the two contacts. In this invention it has been shown that the engagement force can be much larger than the actuation force which permits the substantial reduction in the mass of the seismic mass and thus permits the miniaturization of the mechanical tilt switch.

Two methods of achieving a mechanical advantage wherein the engagement force exceeds the actuation force are disclosed above. In both cases the engagement force is more than twice as large as the actuation force and in most cases a much greater amplification is achieved.

The term "actuation angle" as used herein means the angle at which the tilt switch must be rotated from a neutral position to where the switch closes.

In the example of FIG. 4, where a contact surface comprises abrasive particles in a conductive matrix, the conductive matrix is preferably gold, however, other metals such as copper, silver or platinum could be used in particular situations.

In examples illustrated here, the contacts have been supported by a contact beam which has been shown in the examples herein as a rectangular beam. Also, the hinge has been usually shown as a specific reduction in the beam thickness at a particular point along the beam. Naturally other beam geometries could be used and the hinge need not be at a specific location, but can be distributed along the entire length of the beam. In this case, the flexibility of the beam itself would be used in place of a specific hinged section. Therefore, although a specific rectangular beam with a localized hinge has been illustrated in most of the above examples, this invention is not limited thereby and beams of any shape and hinges of any type, including a continuously distributed hinge, are considered to be merely variations of the examples illustrated above.

For simplicity, the contact surfaces have been shown as flat planes in the above examples. In many implementations, it is desirable that the contact surfaces be curved so as to facilitate the engagement and disengagement of the contacts without creating excessive friction loads or wedging actions. In some cases, for example, the curvature of the contact would have an approximate radius of curvature equal to the length of the associated beams from the contact to the pivot point. In this case the contacts would roll into engagement and roll out of engagement.

In the examples illustrated herein, in some cases the contact is a separate component which is attached to the contact beam whereas in other cases it is merely a particular part of the contact beam. For the purposes of this disclosure, in both of these cases the contact will be considered to be attached to the beams regardless of whether it is integral with the beam or a separate component.

SAMPLE ANALYSIS OF ONE EMBODIMENT OF THE TILT SWITCH

Figure 14:
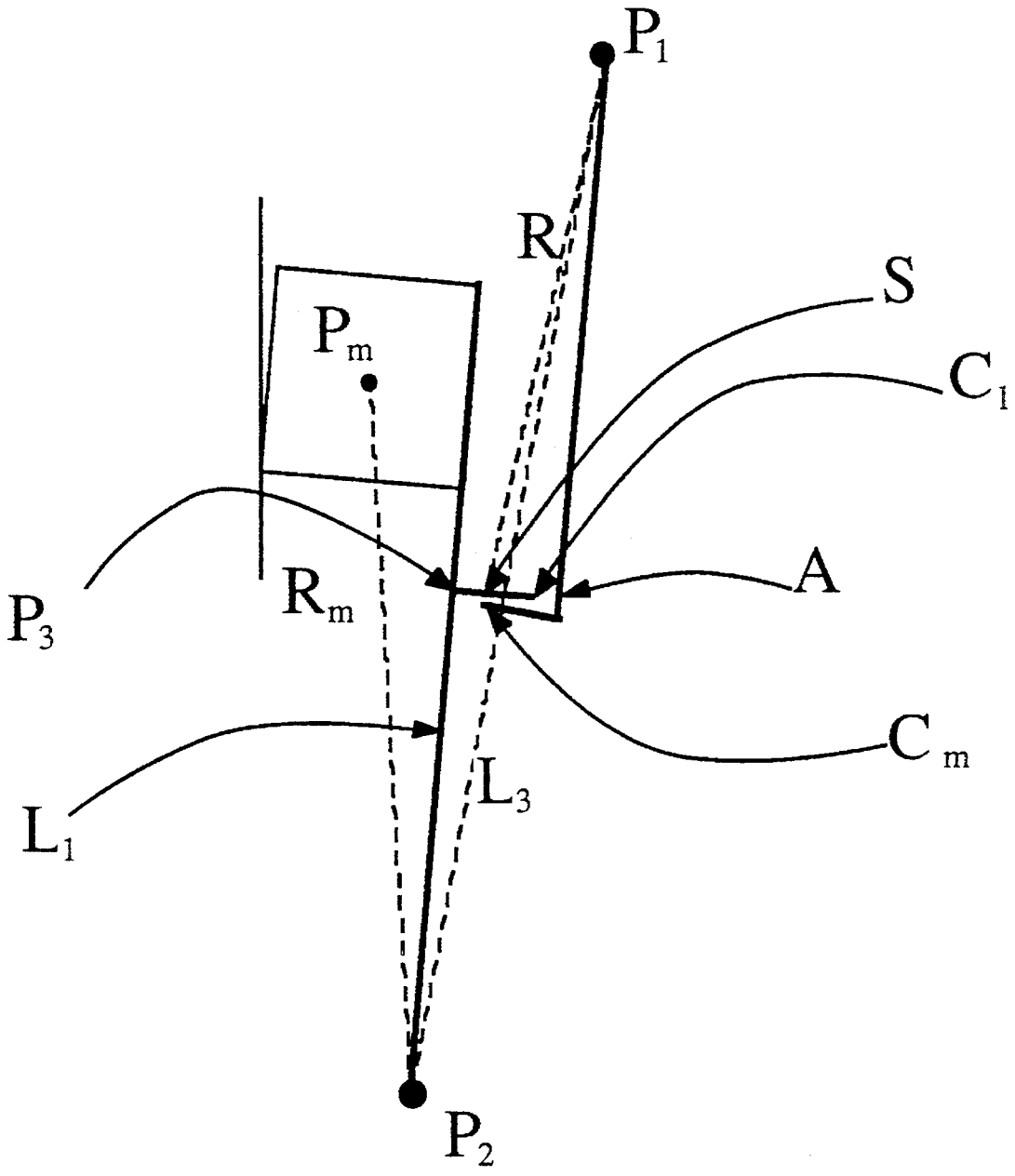
FIG. 14 is a schematic showing various geometric parameters of an alternate version of the tilt switch of this invention.

The analysis of one preferred configuration is presented below and refers to FIG. 14 for the definition of some of the parameters. Other configurations may be analyzed in the same way, with some minor differences in detail.

The switch consists of two beams. The upper one is hinged at $P_1$, the lower one at $P_2$. The upper beam has a flat section A aligned with $P_1$. Below this the upper beam bends or curves to terminate at $C_m$, the electrical contact, below section S on the lower beam. S is a straight section of the lower beam that forms the other electrical contact. $C_l$ is at the right end of section S and $P_3$ is at the left end. When the switch is closed $C_l$ contacts section A and $C_m$ contacts section S. The portion of section A where $C_l$ contacts it is not electrically conductive. The lower beam has a mass m fixed to it, with the point $P_m$ at the center of mass of the whole lower beam including m. $P_m$ will be approximately at the center of mass of m.

When the switch is open, line $P_2P_m$ will be to the left of vertical, and the lower beam will rest against a support. Section A will be somewhat closer to the line $P_1P_2$ than when the switch is closed. The moment in the hinge at $P_1$ will be small, but large enough to hold the light weight of the upper beam in this position. When the switch is rotated clockwise so that line $P_2P_m$ is slightly right of vertical, the mass m will fall to the right, the end $C_l$ of section S will contact section A and push it to the right until $C_m$ contacts section S, thus closing the switch.

| | | |
|---|---|---|
| Let | $h_1$ | be the shortest distance from $C_m$ to section S, |
| | $h_2$ | be the shortest distance from $C_1$ to section A, |
| | $L_1$ | be the distance from $P_2$ to $P_3$, |
| | $L_3$ | be the distance from $P_1$ to $P_2$, |
| | R | be the distance from $P_1$ to $C_m$, |
| | $R_m$ | be the distance from $P_2$ to $P_m$, |
| | S | be the distance from $P_3$ to $C_1$ |
| | $\alpha$ | be the angle from section A to the line $P_1P_2$, |
| | $\gamma$ | be the angle from section A to the line $P_1C_m$, |
| | $\theta$ | be the angle from the line $P_2P_3$ to the line $P_2P_1$ |
| | $\theta_m$ | be the angle from the line $P_2P_m$ to the line $P_2P_3$, |
| | $\phi$ | be the angle from section S to the line $P_3P_2$, |
| | $\psi$ | be the acute angle between the vertical and the line $P_1P_2$. |

note: angles are positive if clockwise as defined.

The parameters $L_1$, $L_3$, R, $R_m$, s, $\gamma$, $\theta$m, and $\phi$ define the geometry of the switch; they may be specified independently within limits. The mass m also must be specified. When the switch is closed, $h_1$ and $h_2$ are zero and then $\alpha$ and $\theta$ may be calculated. When the switch is open then two of the four parameters $h_1$, $h_2$, $\alpha$, and $\theta$ may be specified and the other two calculated. The angle $\psi$ specifies the overall orientation of the switch and may have any value.

The following geometric relations may be derived using elementary trigonometry or basic vector algebra:

If $$L_3\cos(\phi+\theta) - L_l\cos(\phi) + s - R\cos(\phi+\theta-\alpha+\gamma) > 0 \quad (1)$$

then $$h_l = L_l\sin(\phi) + R\sin(\phi+\theta-\alpha+\gamma) - L_3\sin(\phi+\theta);$$

otherwise $$h_l^2 = [L_3 - L_l\cos(\theta) + s\cos(\phi+\theta) - R\cos(\alpha-\gamma)]^2 + [L_l\sin(\theta)j - s\sin(\phi+\theta) + R\sin(\alpha-\gamma)]^2. \quad (2)$$

$$h_2 = L_3\sin(\alpha) + L_l\sin(\theta-\alpha) - s\text{sion}(\phi+\theta-\alpha).$$

One way to determine $\alpha$ and $\theta$ when the switch is closed is first to estimate $\theta$, then set $h_2$ equal to zero and calculate $\alpha$ from Eq.(2):

$$\tan(\alpha) = \frac{s\sin(\phi+\theta) - L_1\sin(\theta)}{L_3 + s\cos(\phi+\theta) - L_1\cos(\theta)} \quad (3)$$

when $h_2 = 0$, and $h_1$ from Eq.(1), and then vary $\theta$ until $h_1$ is zero.

After determining $\alpha$ and $\theta$ for the closed switch, the next step is to calculate the contact force between $C_m$ and section S. This force must be large enough to ensure low electrical resistance at the contact. For the present analysis the assumptions are made that the moments in the hinges at $P_1$ and $P_2$ may be neglected, that friction forces at the contacts are not important, and that the mass of the upper beam may be neglected. These assumptions are not necessary and could be relaxed, but then the details of the analysis would be more complicated than is necessary here.

| | | |
|---|---|---|
| Let | $F_{Cm}$ | be the force of contact between $C_m$ and section S, |
| | $F_{C1}$ | be the force of contact between $C_1$ and section A. |

When friction is neglected these forces are normal to sections S and A, respectively. Setting the net moment on the upper beam equal to zero, with zero moment in the hinge at $P_1$, leads to the equation $$F_{Cm}R\cos(\phi+\theta-\alpha+\gamma) = F_{Cl}[L_3\cos(\alpha) - L_1\cos(\theta-\alpha) + s\cos(\phi+\theta-\alpha)]. \quad (4)$$

Then setting the net moment on the lower beam equal to zero, with zero moment in the hinge at $P_2$, and using the previous equation to eliminate some terms, leads to $$F_{Cl}L_3\cos(\alpha) - F_{Cm}L_3\cos(\phi+\theta) = mgR_m\sin(\psi-\theta-\theta_m). \quad (5)$$

The switch geometry determines $F_{Cl}/F_{Cm}$ and $M_F$, the ratio of $F_{Cm}$ to the right hand side of the last equation, and the mass and switch orientation then determine the values of the forces.

As an example, the following parameters give good values for the force multiplier (distances in inches, angles in degrees):

$L_1$=0.25, $L_3$=0.5013, R=0.2518, s=0.03, $\gamma$=3.26, $\phi$=87.0, With these values, the equations above yield $\alpha_{cl}$=4.75, $\theta_{cl}$=2.08 $F_{Cm}$=77.9 mg $R_m$ $\sin(\psi-\theta-\theta_m)$ when the switch is closed. That is, $M_F$ is 77.9 per inch. Also, $F_{Cl}/F_{Cm}$ is 0.0418.

When the switch is open ($h_2$ greater than zero), the angle $\alpha$ will be less than $\alpha_{cl}$, say $\alpha = \alpha_{op}$=2.0 degrees. $h_1$ must be large enough to prevent sparking. The dielectric strength of air at standard density is 31 kilovolts per centimeter (Standard Handbook for Electrical Engineers). If the tilt switch is to handle 120 volts AC, the crest voltage will be 170 volts, and the gap must be at least 170 over 31,000 or 0.0055 centimeters or 0.002 inches. For 12 volts DC the gap must be larger than 0.00015 inches. Successive approximations with Eqs (1) and (2), using the geometry parameters above with $\alpha=\alpha_{op}$=2.0 and $h_1$=0.004, yields $\theta_{op}$=9.05 and $h_2$=0.018.

If $\theta=\theta_{op}$, then the arm $P_2P_m$ will be vertical when $\psi-\theta_{op}-\theta_m$ is zero. For the switch to be surely open, $\psi$ must be less than this by some angle $\delta\psi_{cl}$, say 5 degrees, or more; if $\psi_{op}$ is the maximum $\psi$ for a sure open, then $\psi_{op}-\theta_m$ is $\theta_{op}-\delta\psi_{cl}$, 4 degrees with the numbers above.

When the mass m and $R_m$ are specified, and $F_{Cm,cl}$, the minimum $F_{Cm}$ for solid closure is given, then $\psi_{cl}$, the minimum $\psi$ for solid closure, satisfies $$\sin(\psi_{cl} - \theta_{cl} - \theta_m) = \frac{F_{Cm,cl}}{M_F mgR_m}. \quad (6)$$

To change the switch from a sure open to a solid close, it must be rotated through an angle $\Delta\psi$ greater than $\psi_{cl}-\psi_{op}$, or $$\Delta\psi > \psi_{cl} - \psi_{op} = \theta_{cl} - \theta_{op} + \arcsin\left(\frac{F_{Cm,cl}}{M_F mgR_m}\right) + \delta\psi_{cl}. \quad (7)$$

To continue the numerical example, suppose that $\Delta\psi$ is 10 degrees, $F_{Cm,cl}$ is 5 grams force, and $R_m$ is 0.4 inches. Then with $\delta\psi_{cl}$=5 degrees and the other numbers from above, the minimum required mass m is 0.77 grams.

Note that when $\psi$ is just less than $\psi_{op}+\delta\psi_{cl}$ the switch is still open, with a gap between contacts large enough to prevent arcing. When $\psi$ increases just slightly more, the mass falls over center, the contacts touch and the argument of the sine function in the expression for $F_{Cm}$ becomes $(\theta_{op}-\theta_{cl}$ or 6.97 degrees. The resulting contact force becomes 77.9 times mg times $R_m$ times the sine of 6.97, or 3.78 mg, and if the mass is greater than 1.3 grams this force is greater than 5 grams, enough for a solid closure. Then the switch will have no orientation such that the contacts are close enough for current to flow but the closure is not solid.

Although several preferred embodiments are illustrated and described above, there are possible combinations using other geometries, materials and different dimensions for the components that perform the same functions. This invention is not limited to the above embodiments and should be determined by the following claims.

What is claimed is:

1. A tilt switch comprising:

a housing;

a beam flexibly attached to and substantially within said housing; said beam having a length substantially greater than its width or thickness;

a first contact within said housing attached to said beam, said contact having a portion at an angle with respect to said length, said portion of said contact having a first contact surface;

a mass within said housing positioned to apply an actuation force on and in the direction of motion of said beam, said actuation force resulting from gravity acting on said mass when said housing is tilted at an angle exceeding a predetermined actuation angle;

a second contact within said housing, said second contact having a second contact surface;

stop means to limit the motion of said beam when said housing is at a second predetermined angle less than the vertical, and wherein said tilting of said housing causes said beam to move causing said first contact surface to engage said second contact surface with a contact engagement force; and said contact engagement force during contact of both said surfaces exceeds said actuation force.

2. The invention in accordance with claim 1 wherein said engagement force is at least twice as great as said actuation force.

3. The invention in accordance with claim 1 wherein said beam flexible attachment comprises a hinge.

4. The invention in accordance with claim 1 wherein said beam is flexible along its length.

5. The invention in accordance with claim 1 wherein said housing comprises an hermetically sealed glass enclosure.

6. The invention in accordance with claim 1 wherein said mass is attached to said beam.

7. The invention in accordance with claim 1 wherein said mass is separately supported and adjacent to said beam.

8. The invention in accordance with claim 1 wherein said housing comprises a sealed plastic enclosure.

9. The invention in accordance with claim 1 wherein said contact surface of at least one of the contacts is coated with a coating comprising an abrasive and a conductive matrix.

10. The invention in accordance with claim 1 wherein said mass is spherical and is movable on said beam substantially along said length.

11. The invention in accordance with claim 1 wherein at least one of said contacts comprises a snap action means.

12. The invention in accordance with claim 1 wherein said mass is made from a material which is at least twice as dense as steel.

13. The invention of claim 1 wherein said second contact is a portion of said housing.

14. The invention in accordance to claim 1 further comprising:

a liquid substantially filling said housing, said liquid exerting a force opposing motion of said first contact and wherein said switch is thereby made resistant to the effects of vibration.

15. The invention in accordance with claim 14 wherein said damping liquid is an oil.

16. The invention in accordance with claim 14 wherein said damping liquid is a silicone oil.

17. The invention in accordance with claim 14 wherein said damping liquid is a transformer fluid.

18. The invention in accordance with claim 14 wherein said switch is a tilt switch.

19. A tilt switch comprising:

a housing;

a first contact mounted within said housing, said contact having a first contact surface, said surface having a coating, said coating comprising abrasive particles and a conductive matrix;

a second contact mounted within said housing and spaced apart from said first contact; and means to cause said first contact surface to engage said second contact;

and wherein said coating results in a substantially less contact resistance than without said coating.

20. The invention in accordance with claim 19 wherein said abrasive particles are diamonds.

21. The invention in accordance with claim 19 wherein said abrasive particles are silicon carbide.

22. The invention in accordance with claim 19 wherein said conductive matrix is gold.

23. A reed switch comprising:

a housing;

a first contact mounted within said housing, said contact having a first contact surface, said surface having a coating, said coating comprising abrasive particles and a conductive matrix;

a second mounted within said housing and spaced apart from said first contact;

and, means to come said first contact surface to engage said second contact.

24. The invention in accordance with claim 23 wherein said abrasive particles are diamonds.

25. The invention in accordance with claim 23 wherein said abrasive particles are silicon carbide.

26. A reed tilt switch comprising:

an hermetically sealed glass housing;

a beam flexibly attached to and substantially within said glass housing, said beam rotatably movable within said glass housing;

a first contact within said glass housing and attached to said beam, said contact having a first contact surface;

a mass within said glass housing positioned to apply an actuation force on and in the direction of rotation of said beam, said force resulting from gravity acting on said mass when said glass housing is tilted at an angle exceeding a predetermined actuation angle;

a second contact within said glass housing, said second contact having a second contact surface, said second contact surface positioned to engage said first contact surface with an engagement force when said glass housing is tilted at an angle greater than said actuation angle; and stop means to limit the motion of said beam when said housing is at an angle less than the vertical;

and wherein said contact engagement force during engagement of both said contact surfaces exceeds said actuation force.

27. The invention in accordance with claim 26 wherein said mass is made from a material which is at least twice as dense as steel.

28. A rolling ball tilt switch comprising:

a housing;

a beam flexibly attached to and substantially within said housing, said beam rotatably movable within said housing;

a first contact within said housing, said contact having a first contact surface, said surface having a coating, said coating comprising abrasive particles and a conductive matrix;

a ball within said housing positioned to roll on and apply an actuation force on and in the direction of rotation of said beam, said force resulting from gravity acting on said ball when said housing is tilted at an angle exceeding a predetermined actuation angle; and a second contact within said housing, said contact having a second contact surface, said surface positioned to engage said first contact surface with an engagement force when said housing is tilted at an angle greater than said actuation angle.

29. A rolling ball tilt switch comprising:

a housing;

a beam attached to and substantially within said housing, said beam adapted to rotate within said housing;

a first contact within said housing and integral with to said beam;

a ball within said housing positioned to roll and apply an actuation force on and in the direction of rotation of said beam said force resulting from gravity acting on said ball when said housing is tilted at an angle exceeding a predetermined actuation angle;

a second contact within said housing positioned to engage said first contact with an engagement force when said housing is tilted at an angle greater than said actuation angle; and, mechanical advantage means to cause said contact engagement force to exceed said actuation force.

30. A tilt switch comprising:

a housing;

a beam flexibly attached to and substantially within said housing; said beam having a length substantially greater than its width or thickness;

a first contact within said housing attached to said beam, said contact having a portion at an angle with respect to said length, said portion of said contact having a first contact surface;

a mass within said housing positioned to apply an actuation force on and in the direction of motion of said beam said actuation force resulting from gravity acting on said mass which contacts said beam when said housing is tilted at an angle exceeding a predetermined actuation angle;

a second contact within said housing, said second contact having a second contact surface;

stop means to limit the motion of said mass when said housing is at a second predetermined angle less than the vertical, and wherein said tilting of said housing causing said mass to rotatably move which causes said first contact surface to engage said second contact surface with a contact engagement force; and said contact engagement force during contact of both said surfaces exceeds said actuation force.

31. A tilt switch comprising:

a housing;

a beam flexibly attached to and substantially within said housing, said beam having a length substantially greater than its width or thickness;

a first contact within said housing attached to said beam, said contact having at least one portion at an angle with respect to said length, said portion of said contact having a first contact surface;

a mass within said housing positioned to apply an actuation force on and in the direction of motion of said beam, said actuation force resulting from gravity acting on said mass when said housing is tilted at an angle exceeding a first predetermined actuation angle in a first direction or at an angle exceeding a second predetermined actuation angle in the direction opposite to said first direction;

a second contact within said housing, said second contact having a second contact surface, said second contact located in said first direction;

a third contact within said housing, said third contact having a third contact surface, said third contact located in the direction opposite to said first direction;

and wherein said tilting of said housing in said first direction at an angle exceeding a first predetermined actuation angle causing said beam to move in said first direction causes said first contact surface to engage said second contact surface with a first contact engagement force;

and said tilting of said housing in said second direction at an angle exceeding a second predetermined actuation angle causing said beam to move in said direction opposite to said first direction causes said first contact surface to engage said third contact surface with a second contact engagement force; and said first contact engagement force during engagement of said first and second contact surfaces exceeds said actuation force, and said second contact engagement force during engagement of said first and third contact surfaces exceeds said actuation force.

32. A tilt switch comprising:

a housing;

a beam flexibly attached to and substantially within said housing, said beam having a length substantially greater than its width or thickness;

a first contact within said housing attached to said beam, said contact having a first contact surface;

a mass within said housing, said mass attached to said first contact means, said first contact surface being closer to where said beam is flexibly attached to said housing than said mass;

a second contact within said housing, said second contact having a second contact surface;

said mass positioned to apply an actuation force on and in the direction of motion of said beam, said actuation force resulting from gravity acting on said mass when said housing is tilted at an angle exceeding a predetermined actuation angle;

said tilting of said housing causing said beam to move causes said first contact surface to engage said second contact surface with a contact engagement force; and said contact engagement force during contact of both said surfaces exceeds said actuation force.

* * * * *